US007137375B2

(12) United States Patent
Maeda et al.

(10) Patent No.: US 7,137,375 B2
(45) Date of Patent: Nov. 21, 2006

(54) DECOMPRESSION MECHANISM FOR ENGINE

(75) Inventors: Kazuyuki Maeda, Iwata (JP); Tomoki Kaneshiro, Iwata (JP)

(73) Assignee: Yamaha Motor Co., Ltd., Shizuoka-ken (JP)

( * ) Notice: Subject to any disclaimer, the term of this patent is extended or adjusted under 35 U.S.C. 154(b) by 0 days.

(21) Appl. No.: 11/041,517

(22) Filed: Jan. 24, 2005

(65) Prior Publication Data

US 2005/0161012 A1 Jul. 28, 2005

(30) Foreign Application Priority Data

Jan. 22, 2004 (JP) ..... 2004-014050
Jun. 3, 2004 (JP) ..... 2004-165941

(51) Int. Cl.
*F02D 13/00* (2006.01)
*F02D 15/00* (2006.01)
*F02D 17/00* (2006.01)

(52) U.S. Cl. ..... 123/182.1

(58) Field of Classification Search ..... 123/182.1
See application file for complete search history.

(56) References Cited

U.S. PATENT DOCUMENTS 4,455,977 A * 6/1984 Kuczenski ..... 123/182.1
4,790,271 A * 12/1988 Onda ..... 123/182.1
5,197,422 A 3/1993 Oleksy et al.
5,301,643 A 4/1994 Garcyalny
5,711,264 A 1/1998 Jezek et al.
5,809,958 A 9/1998 Gracyalny
5,816,208 A * 10/1998 Kimura ..... 123/182.1
5,823,153 A 10/1998 Santi et al.
5,957,101 A 9/1999 Schmitz et al.
6,073,599 A * 6/2000 Kimura ..... 123/182.1
6,250,271 B1 * 6/2001 Ikuma et al. ..... 123/182.1
6,343,579 B1 * 2/2002 Yasuyama et al. ..... 123/182.1
6,343,582 B1 * 2/2002 Peng ..... 123/182.1
6,394,054 B1 * 5/2002 Rado et al. ..... 123/182.1

FOREIGN PATENT DOCUMENTS

EP 1 380 729 A1 1/2004

(Continued)

OTHER PUBLICATIONS

European Search Report dated May 9, 2005 for EP 05 00 1239.

*Primary Examiner*—Stephen K. Cronin
*Assistant Examiner*—Arnold Castro
(74) *Attorney, Agent, or Firm*—Knobbe, Martens, Olson & Bear, LLP.

(57) ABSTRACT

A four stroke engine has a camshaft driven by a crankshaft. A decompression member is disposed on the camshaft. The decompression member is movable between a decompression position and a non-decompression position. A portion of the decompression member generally places the valve at an open position when the decompression member is placed at the decompression position and releases the valve from the open position when the decompression member is placed at the non-decompression position. A regulating member is disposed on the camshaft. The regulating member regulates the decompression member to prevent movement of decompression member from the decompression position when the regulating member is placed at a first position. The regulating member releases the decompression member from the decompression position when the regulating member is placed at a second position. A bias member is arranged to urge the regulating member toward the first position. The regulating member is movable toward the second position against the urging force of the bias member when a rotational speed of the camshaft exceeds a predefined speed.

21 Claims, 14 Drawing Sheets

FOREIGN PATENT DOCUMENTS

| | | |
|---|---|---|
| JP | 6-10107 | 3/1994 |
| JP | 2509668 | 6/1996 |
| JP | 2001-90516 | 4/2001 |

* cited by examiner

DECOMPRESSION MECHANISM FOR ENGINE

PRIORITY INFORMATION

The present application is based on and claims priority under 35 U.S.C. § 119 to Japanese Patent Applications No. 2004-014050, filed on Jan. 22, 2004, and No. 2004-165941, filed on Jun. 3, 2004, the entire contents of which are expressly incorporated by reference herein.

BACKGROUND OF THE INVENTION

1. Field of the Invention

The present invention generally relates to a decompression mechanism for an engine, and more particularly relates to an improved decompression mechanism that decompresses a combustion chamber of the engine when the engine is started.

2. Description of Related Art

Conventionally, in four stroke engines, a decompression mechanism is used to decompress a combustion chamber to ease cranking when a starting device starts the engine or to stop the engine. Typically, the decompression mechanism actuates an intake valve or an exhaust valve to open the valve at the beginning of the engine cylinder's compression stroke.

In prior engine designs, the decompression mechanism has been incorporated into a camshaft of the engine such that the decompression mechanism opens the until the rotational speed of the camshaft reaches generally a preset speed, at which time the decompression mechanism allows the valve to close. Typically, the decompression mechanism uses a centripetal force that increases when the rotational speed of the camshaft increases. For example, Japanese Patent Publication No. P2001-90516A, Japanese Utility Model Publication No. hei 06-10107 and Japanese Utility Model No. 2509668 disclose such decompression mechanisms. Generally, the decompression mechanism has a number of components and members. Thus, the decompression mechanism occupy a relatively large space.

The valves of the engine are usually disposed in a cylinder head of the engine. This valve arrangement is known as the OHV (overhead valve) mechanism. To actuate the valves, many engines use one or more camshafts, which in some designs are disposed in a crankcase of the engine below the cylinder head. Further, the engine can have two banks disposed in a V configuration. Because of this configuration, two camshafts are provided for the respective banks. The camshafts are inevitably placed close to each other because the camshafts are located at the bottom of the V configuration.

Due to such a close positioning, the engine can hardly provide an enough space to dispose the conventional decompression mechanism around the camshaft.

SUMMARY OF THE INVENTION

An aspect of the present invention involves a four stroke engine comprising an engine body defining a cylinder bore. A piston is reciprocally disposed within the cylinder bore and defines a combustion chamber with the engine body and the cylinder bore. A crankshaft is coupled to the piston so as to rotate with movement of the piston. At least one valve is movable between a closed position and at least a first open position. The combustion chamber is open when the valve is moved to the first open position. A camshaft is driven by the crankshaft. The camshaft has a cam portion to move the valve. A decompression member is disposed on the camshaft. The decompression member is movable between a first position and a second position. A portion of the decompression member being configured to place the valve generally at the first open position when the decompression member is placed at the first position and releases the valve from the first open position when the decompression member moves to the second position. A regulating member is carried by the camshaft. The regulating member is movable between a regulating position and a non-regulating position wherein the regulating member regulates movement of the decompression member when the regulating member is at its regulating position. The regulating member releases the decompression member from the first position when the regulating member is at its non-regulating position. A bias member is arranged to urge the regulating member toward its regulating position. The regulating member is configured so as to move toward its non-regulating position against the urging force of the bias member when a rotational speed of the camshaft exceeds a predefined speed.

In accordance with another aspect of the present invention, a four stroke engine comprises an engine body defining a cylinder bore. A piston is reciprocally disposed within the cylinder bore and defines a combustion chamber with the engine body and the cylinder bore. A crankshaft is rotatable with a movement of the piston. At least one valve is movable between at least a first open position and a closed position. The combustion chamber is open when the valve is placed at the first open position. A camshaft is driven by the crankshaft. The camshaft has a cam portion to actuate the valve. A first member of a decompression mechanism is movable within a first guide aperture of the camshaft. The first member has a first end and a second end. A second member of the decompression mechanism is movable within a second guide aperture. A bias member is disposed at one end of the second member to urge the second member to engage the first member. The second member is arranged to keep the first member in a decompression position where the first end of the first member projects out of the camshaft to move the valve to the first open position when a centrifugal force affecting the second member does not overcome an urging force of the bias member. The second member is further arranged to release the first member from the decompression position when the centrifugal force overcomes the urging force of the bias member. A center of gravity of the first member is positioned closer to the second end than the first end such that the first member withdraws into the first guide aperture when the centrifugal force affects the first member.

The integration of the members of the decompression mechanism into the camshaft reduces the effective size of the decompression mechanism, thereby allowing it to fit into small spaces within the engine. Additionally, those portions of the decompression mechanism that must project beyond the surface of the camshaft, once the engine has started and is running, can be located at positions along the camshaft where they do not interfere with the operation of the cam surfaces of the crankshaft and the corresponding surfaces of the followers (e.g., tappets).

BRIEF DESCRIPTION OF THE DRAWINGS

These and other features, aspects and advantages of the present invention are now described with reference to the drawings of preferred embodiments, which embodiments are intended to illustrate and not to limit the present invention, and in which.

DETAILED DESCRIPTION OF THE PREFERRED EMBODIMENT OF THE INVENTION

Overall Construction of Engine Unit

With reference to FIGS. 1–12, an overall construction of an engine unit 30 configured in accordance with certain features, aspects and advantages of the present invention is described.

Figure 1:
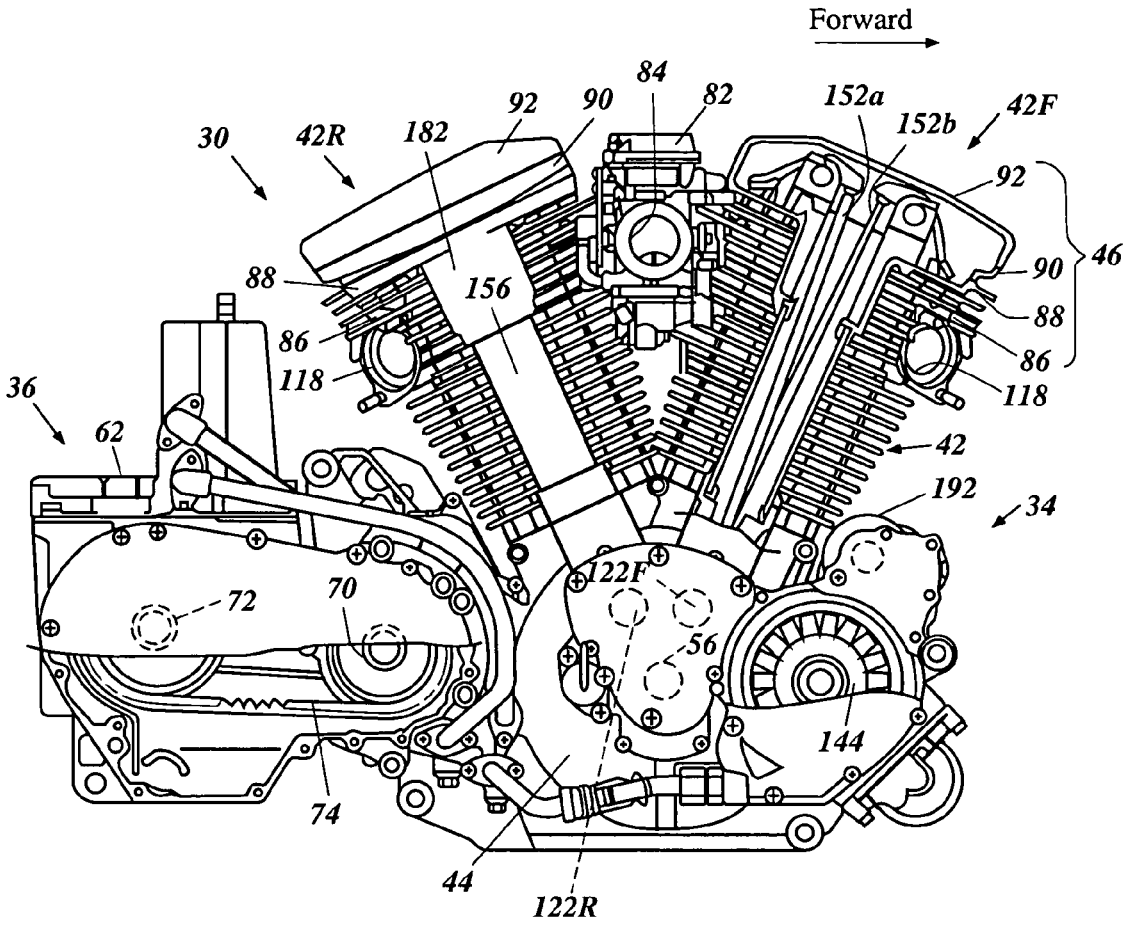
FIG. 1 illustrates a side elevational view of an engine configured in accordance with certain features, aspects and advantages of the present invention, with some covers of the engine partially removed to illustrate internal components thereof.
Figure 2:
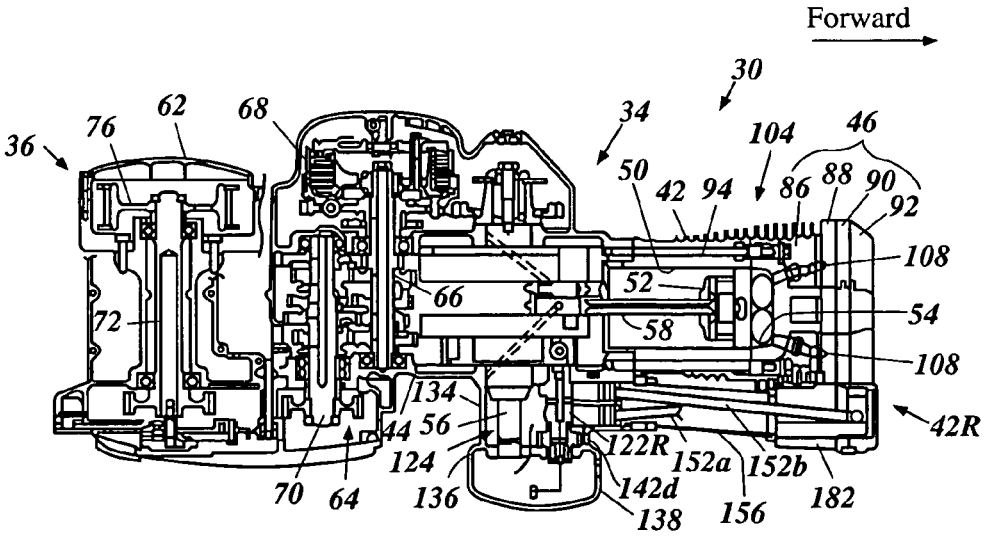
FIG. 2 illustrates a sectional view of the engine taken through a rear cylinder, crankshaft and transmission of the engine of FIG. 1.
Figure 3:
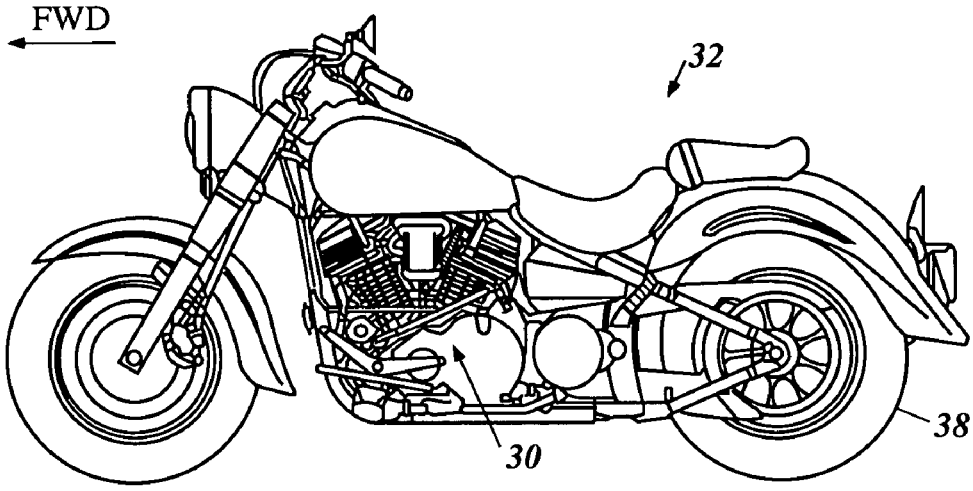
FIG. 3 illustrates a side elevational view of a motorcycle in which the engine of FIG. 1 can be used.

With reference to FIGS. 1–3, the engine unit 30 preferably is mounted on a motorcycle 32 as shown in FIG. 3. The illustrated engine unit 30 comprises an internal combustion engine 34 and a transmission 36. The engine 34 generates a locomotive power and the transmission 36 transmits the locomotive power to a propulsive wheel. In the illustrated embodiment, the propulsive wheel is a rear wheel 38.

The engine 34 preferably is an OHV-type, four stroke engine. The illustrated engine 34 has two cylinders disposed in a V configuration. Each cylinder preferably has two intake valves and two exhaust valves. Also, the engine 34 preferably is air-cooled type engine. The engine 34, however, merely exemplifies one type of an engine. Other types of valved engines can also incorporate the present decompression mechanism. Accordingly, the engine configurations, cooling types and other engine features described below are not intended to limit the scope of the present invention.

Other applications will be apparent to those of ordinary skill in the art in light of the description herein.

As used through this description, the terms "forward" and "front" mean at or to the side where the leading end of the motorcycle 32 is positioned when the motorcycle 32 proceeds, and the terms "rear" and "rearward" mean at or to the opposite side of the front side, unless indicated otherwise or otherwise readily apparent from the context use. The arrows FWD indicate the front side of the motorcycle 32 or the engine 34. Also, as used in this description, the term "horizontally" means that the subject portions, members or components extend generally parallel to the ground when the motorcycle 32 stands normally on the ground. The term "vertically" in turn means that portions, members or components extend generally normal to those that extend horizontally.

The engine 34 has an engine body that preferably comprises a cylinder block 42, a crankcase 44 and a pair of cylinder head assemblies 46.

The cylinder block 42 preferably has a front bank 42F and a rear bank 42R. The front and rear banks 42F, 42R extend upward from the crankcase 44 to form the V configuration. Respective bottom ends of the banks 42F, 42R are unitarily formed. Respective top ends of the banks 42F, 42R are spaced apart from each other than the bottom ends.

Each bank 42F, 42R of the cylinder block 42 defines a cylinder bore 50. A piston 52 is reciprocally disposed in each cylinder bore 50. Each cylinder head assembly 46 closes one end of the cylinder bore 50. The cylinder bore 50, the piston 52 and the cylinder head assembly 46 together define a combustion chamber 54.

The crankcase 44 closes each of the another ends of the cylinder bores 50 and journals a crankshaft 56 within a crankcase chamber. The respective pistons 52 are connected to the crankshaft 56 through respective connecting rods 58. Thus, the crankshaft 56 rotates with the reciprocal movement of the pistons 52.

The transmission 36 preferably is disposed in the rear of the crankcase 44. In the illustrated embodiment, the crankcase 44 is unitarily formed with a transmission case 62 of the transmission 36. The transmission case 62 accommodates a transmission mechanism 64 that preferably comprises a plurality of shafts and a plurality of gears. A main shaft 66 is coupled with the crankshaft 44 through a clutch mechanism 68 that is disposed on one side of the main shaft 66. A counter shaft 70 is connected to an output shaft 72 through a chain 74. The output shaft 72 has a drive pulley 76. A belt is wound around the drive pulley and a driven pulley that is disposed on an axle of the rear wheel 30 to transmit the locomotive power of the engine 34 to the rear wheel 38.

The engine 34 includes an intake system through which air is introduced into the combustion chambers 54. The engine 34 also has a fuel supply system through which fuel is supplied to the combustion chambers 54. Preferably, a carburetor 82 is used to introduce the air and to supply the fuel to the combustion chambers 54. The carburetor 82 preferably is disposed in a space between the top ends of the respective banks 42F, 42R. An air intake conduit is coupled to an intake opening 84 of the carburetor 82. The ambient air can be taken into the carburetor 82 through the intake opening 84. The fuel is metered within the carburetor 82 in accordance with an air amount that passes through an air adjusting mechanism of the carburetor 82. Thus, an air/fuel charge is formed within each combustion chamber 54. Alternatively, other charge formers and induction systems can be used to form the air/fuel charge in the individual combustion chambers. For example, a direct or an indirect fuel injection system can be used with the illustrated engine to introduce fuel into the charge.

Figure 4:
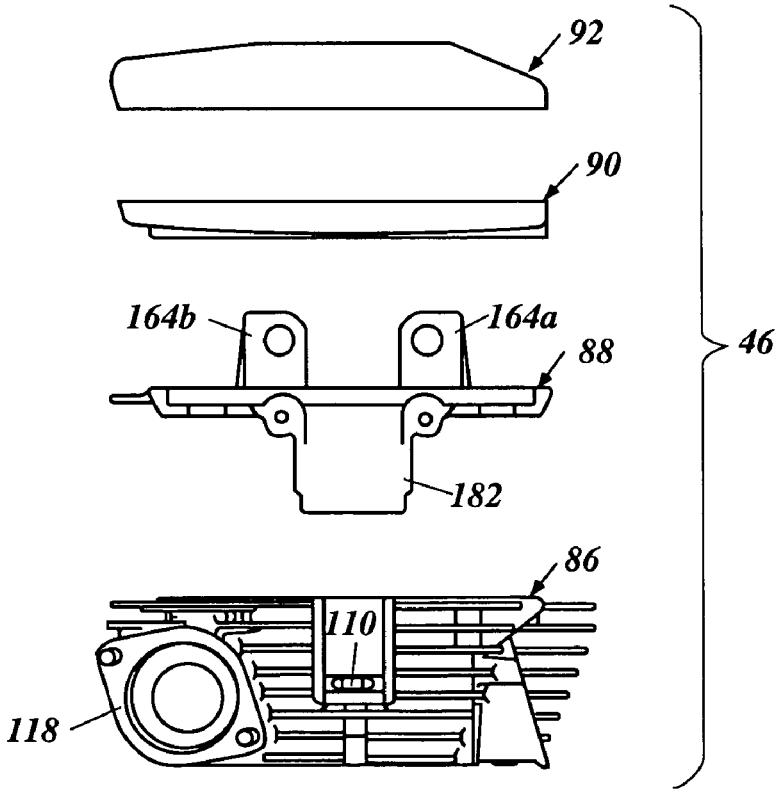
FIG. 4 illustrates an exploded side view of a cylinder head assembly of the engine of FIG. 1.
Figure 5:
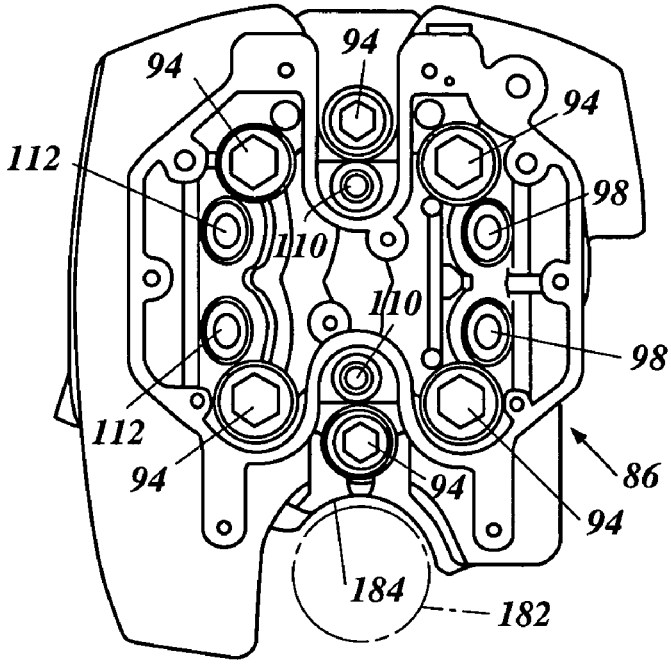
FIG. 5 illustrates a top plan view of a cylinder head of the cylinder head assembly of FIG. 4.
Figure 6:
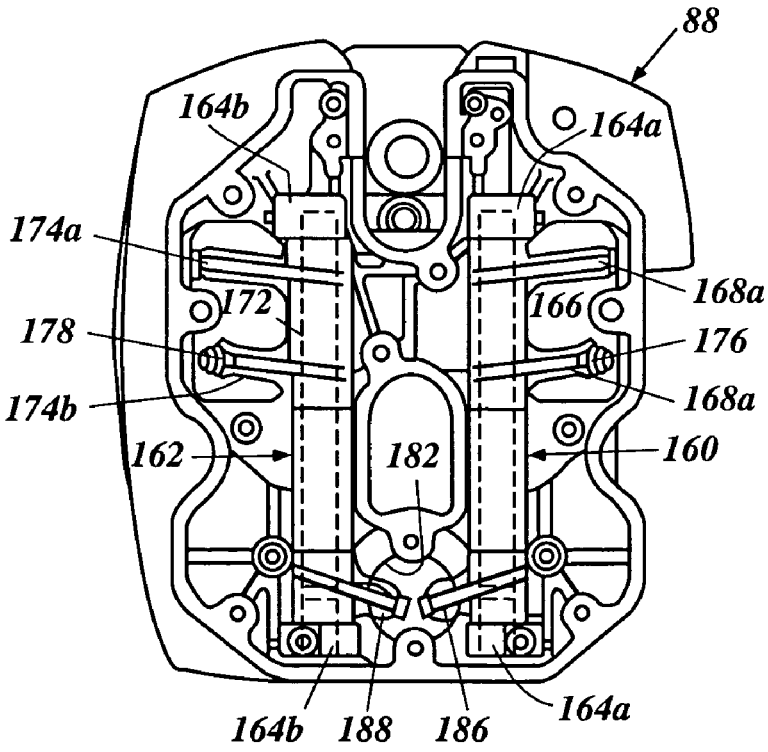
FIG. 6 illustrates a top plan view of a rocker arm mount of the cylinder head assembly of FIG. 5.
Figure 7:
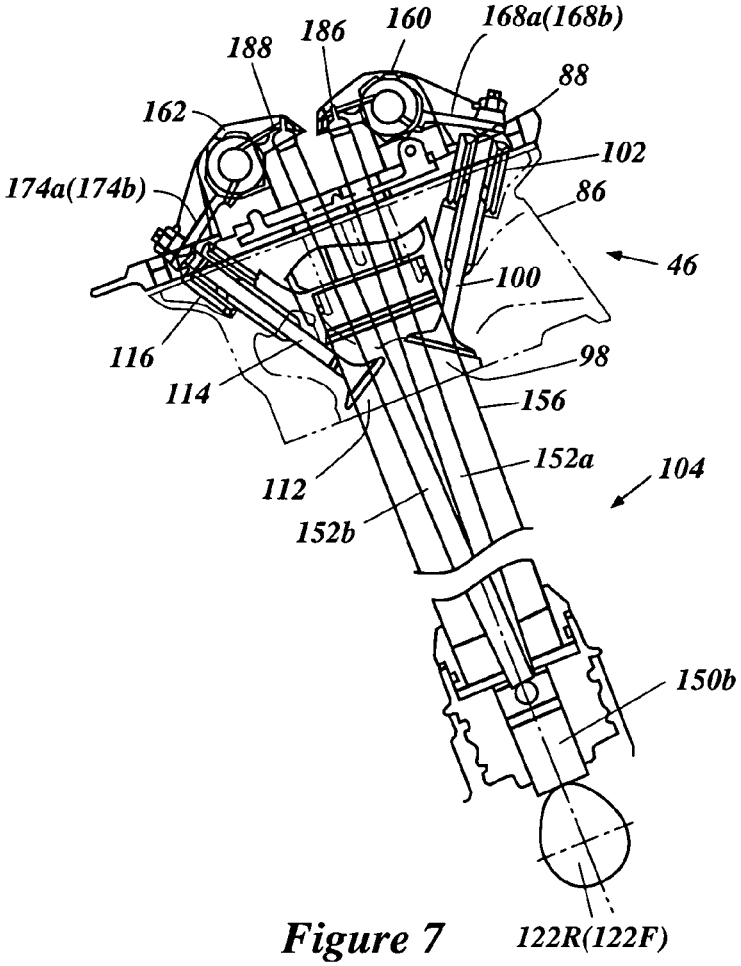
FIG. 7 illustrates a schematic view showing an arrangement of rocker arms, push rods and intake and exhaust valves associated with an upper portion of the rear cylinder of the engine.

With reference to FIGS. 4, 5 and 7, each cylinder head assembly 46 preferably comprises a cylinder head body 86, a rocker arm mount 88, a lower head cover member 90 and an upper head cover member 92. Those members 86, 88, 90, 92 are put on top of one another in this order and are coupled with each other by bolts. A gasket is preferably interposed between the cylinder head and the cover. The cylinder head body 86 is affixed to a top surface of each bank 42F, 42R of the cylinder block 42 by head bolts 94. The head bolts 94 pass through the cylinder block 42 and also fix the cylinder block 42 to the crankcase 44.

Preferably, the lower head cover member 90 is a rim, while the upper head cover member 92 is a lid. The lower and upper head cover members 90, 92 thus together form a cover that closes cylinder head assembly, which in turn closes the combustion chamber 54.

As best shown in FIG. 5, each cylinder head body 86 has two intake ports 98 through which the air/fuel charge is introduced into the combustion chamber 54. As best shown in FIG. 7, in order to open or close each intake port 98, an intake valve 100 is reciprocally disposed in the cylinder head assembly 46. An intake bias spring 102 is disposed about the stem of each intake valve 100 to urge the intake valve 100 toward its closed position. The intake valves 100 can be opened toward its open position by a valve drive mechanism 104, which will be described in greater details below. In other words, each intake valve 100 is movable between a fully opened position and the closed position. In so moving, the valve, when in the intermediate position between the fully opened position and the closed position, opens the combustion chamber.

With reference to FIG. 2, the engine 34 preferably has an ignition system to ignite the air/fuel charges in each combustion chamber 54. Spark plugs 108 of the ignition system preferably are exposed to the combustion chamber 54 through plug holes 110. The plugs 108 generate ignition sparks at suitable intervals. The air/fuel charge burns in the combustion chamber 54. Thus, the pistons 52 move to rotate the crankshaft 56.

The engine 34 preferably has an exhaust system to discharge the burnt charge, i.e., exhaust gases, from the combustion chambers 54. As best shown in FIG. 5, each cylinder head body 86 in the illustrated embodiment has two exhaust ports 112 through which the exhaust gases are discharged from the combustion chamber 54. As best shown in FIG. 7, in order to open or close each exhaust port 112, an exhaust valve 114 is reciprocally disposed on the cylinder head assembly 46. An exhaust bias spring 116 is disposed about the stem of each exhaust valve 114 to urge the exhaust valve 114 toward its closed position. The exhaust valves 114 also can be opened to its open position by the valve drive mechanism 104. In other words, each exhaust valve 114 is movable between the open position and the closed position.

Each bank 42F, 42R has at least one exhaust opening 118. The illustrated exhaust opening 118 is internally connected to the exhaust ports 112. Because an exhaust pipe is connected to each exhaust opening 118, the exhaust gases can be discharged from the engine through the exhaust pipes.

Figure 8:
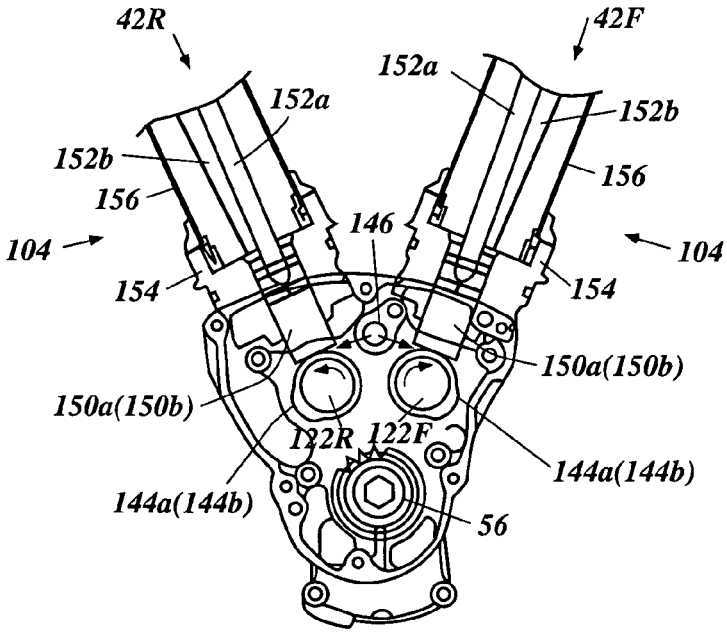
FIG. 8 illustrates a schematic view showing an arrangement of the push rods and camshafts associated with a lower portion of the cylinders and a crankcase of the engine.

With reference to FIGS. 1 and 5–12, the valve drive mechanism 104 preferably includes a camshaft 122F for the front bank 42F and a camshaft 122R for the rear bank 42R. The illustrated camshafts 122F, 122R extend parallel to the crankshaft 56 within the crankcase 44. As shown in FIG. 8, the crankshaft 56 and the respective camshafts 122F, 122R preferably are arranged to form an upside-down triangle in the view of FIG. 8. In the illustrated embodiment, the engine 34 has a cam chamber 124 and a gear chamber 126 on a right hand side of the crankcase 44. Preferably, the cam chamber 124 is located next to the crankcase 44, and the gear chamber 126 is located outside of the cam chamber 124 to interpose the cam chamber 124 between with the crankcase 44 and the gear chamber 126. The crankshaft 56 and the camshafts 122F, 122R preferably extend through the cam chamber 124 to the gear chamber 126.

Figure 9:
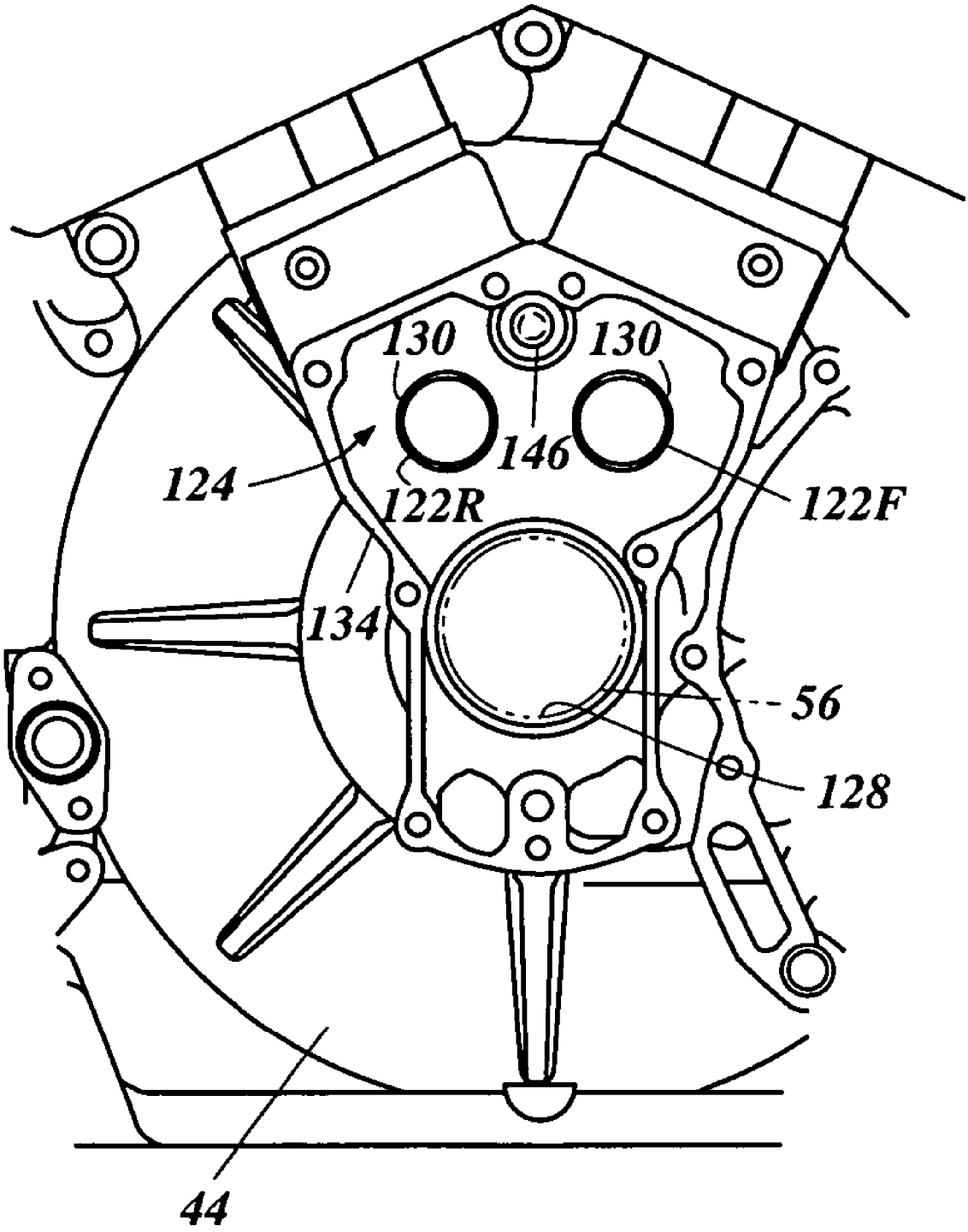
FIG. 9 illustrates a partial side elevational view of a side wall of the crankcase of the engine.
Figure 11:
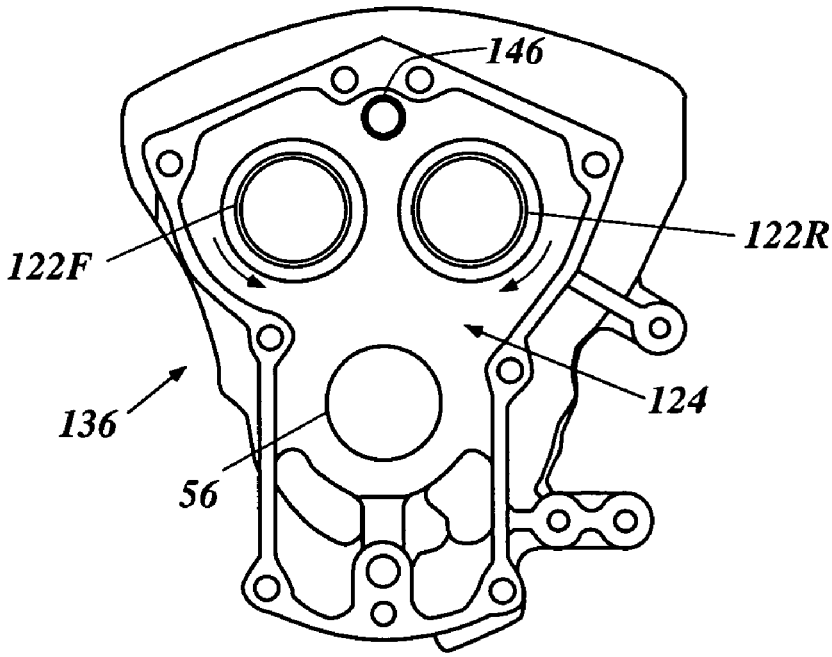
FIG. 11 illustrates another side elevational view of the cam chamber cover of FIG. 10 to show a reverse surface that opposes to a gear chamber cover.
Figure 12:
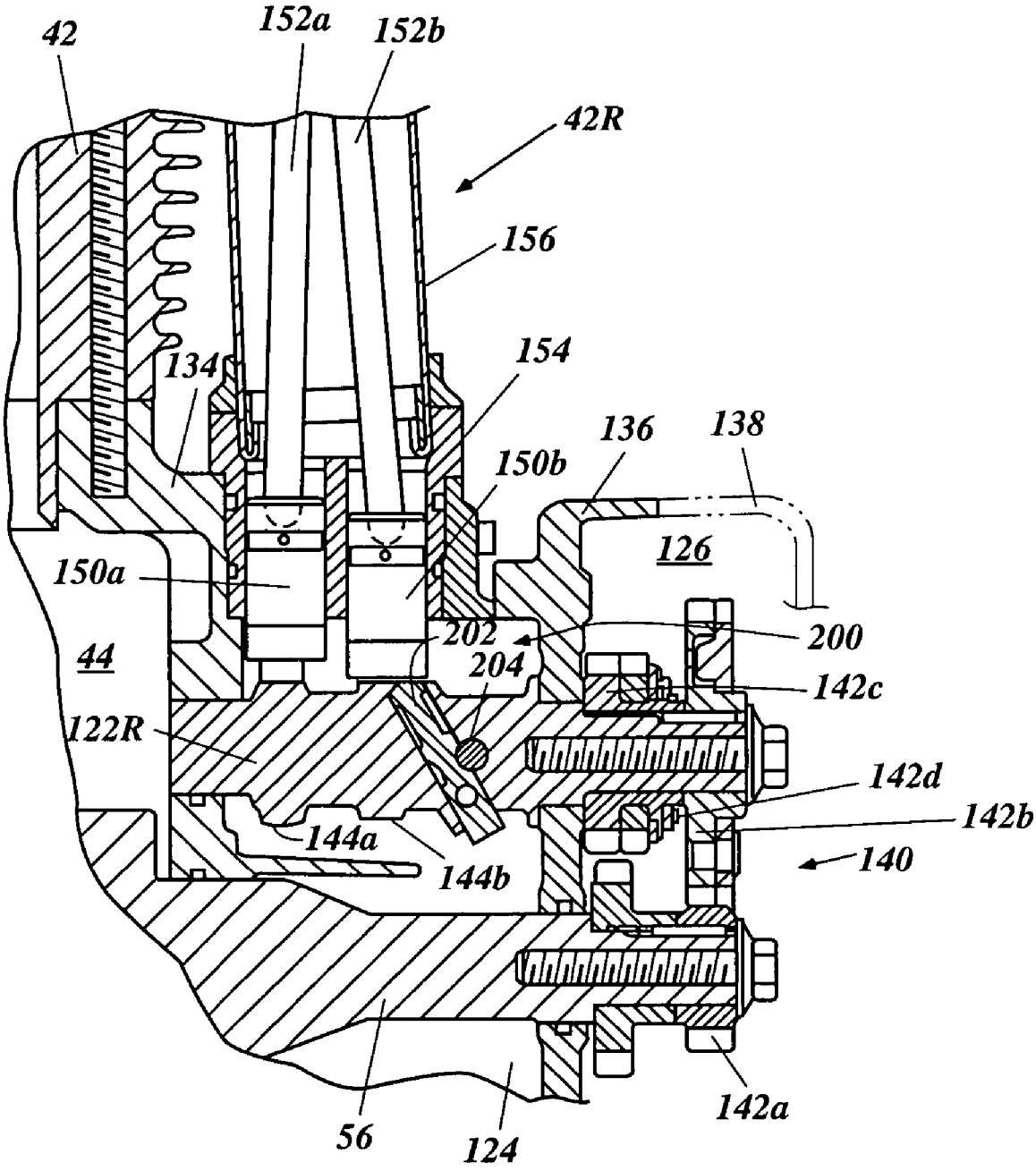
FIG. 12 illustrates a partial, front cross-sectional view of the engine taken along the respective axes of the crankshaft and one of the camshafts to show a decompression mechanism configured in accordance with a preferred embodiment of the present invention.
Figure 13:
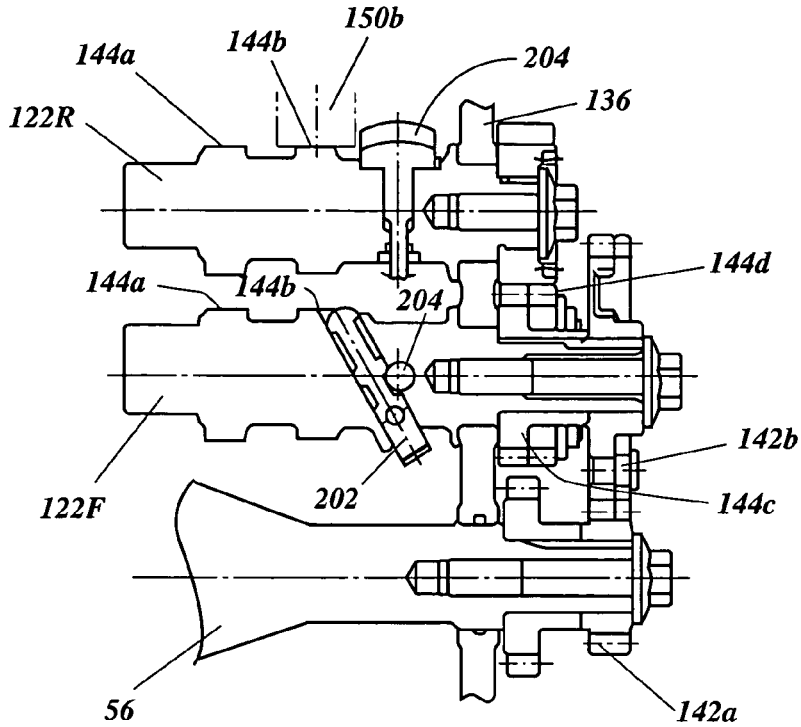
FIG. 13 illustrates a schematic sectional view taken along the respective axes of the crankshaft and the camshafts, with the upper camshaft in the figure schematically showing only a regulating pin of the decompression mechanism of FIG. 12.
Figure 14:
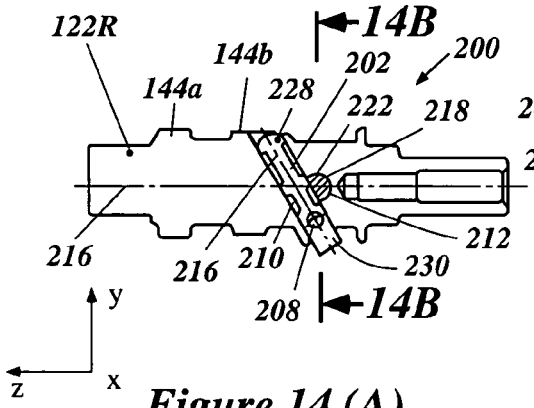
FIG. 14(A) illustrates a schematic cross-sectional view taken along the lines 14A—14A of FIG. 14(B) (i.e., YZ plane), wherein a decompression pin is placed in a decompression position.
FIG. 14(B) illustrates a schematic cross-sectional view of the camshaft taken along the lines 14B—14B of FIG. 14(A) (i.e., XY plane), wherein the decompression pin is placed in the compression position.
Figure 14:
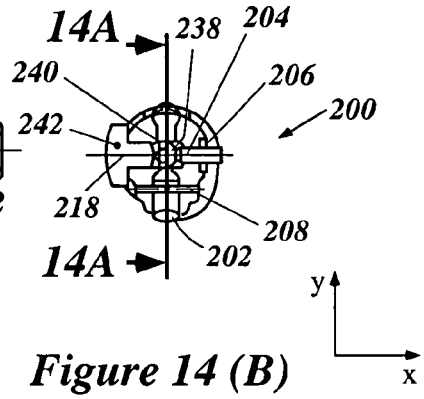
Figure 15:
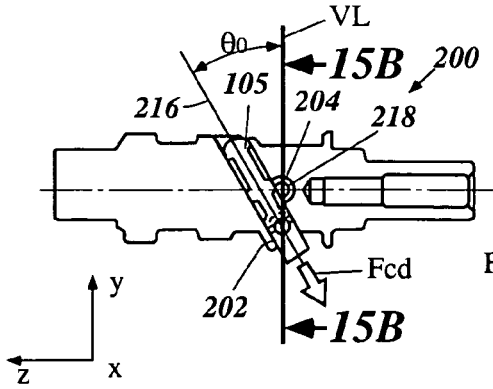
FIG. 15(A) illustrates a schematic cross-sectional view of the camshaft taken along the lines 15A—15A of FIG. 15(B), wherein the decompression pin is placed in a released (non-decompression) position.
FIG. 15(B) illustrates a schematic cross-sectional view of the camshaft taken along the lines 15B—15B of FIG. 15(A), wherein the decompression pin is placed in the released (non-compression) position.
Figure 15:
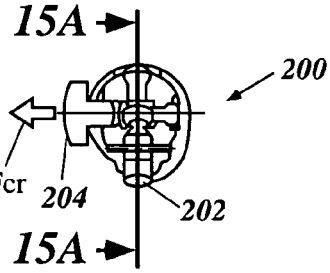

With reference to FIGS. 9, 11 and 12, a side wall of the crankcase 44 on the right hand side has a crankshaft bearing 128 and camshaft bearings 130 to journal those shafts 56, 122F, 122R. A chamber wall 134 extends from the side wall of the crankcase 44 toward outside of the crankcase 44 (i.e., toward the gear chamber 126). A cam chamber cover 136 preferably is affixed to the chamber wall 134 to define the camshaft chamber 124 together with the chamber wall 134. The crankshaft 56 and the camshafts 122F, 122R further extend to the gear chamber 126 beyond the cam chamber cover 136.

Figure 10:
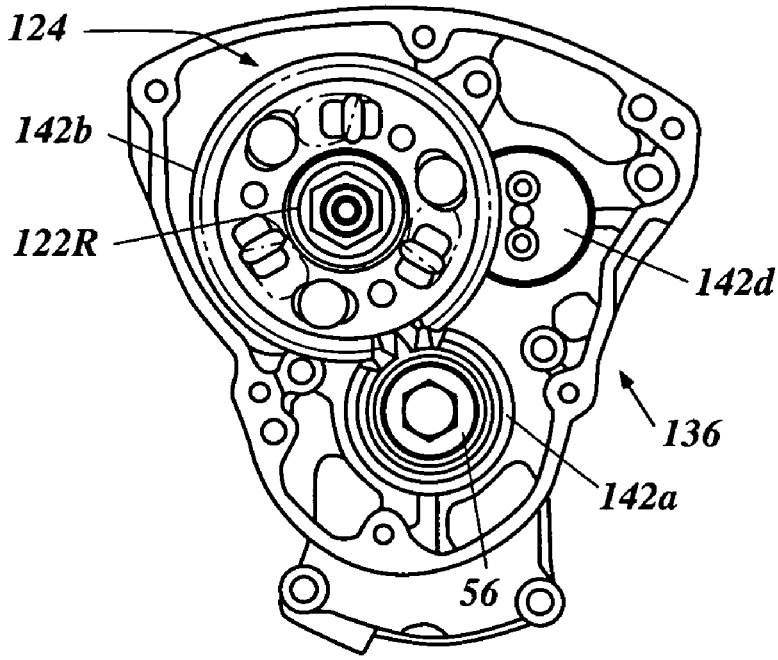
FIG. 10 illustrates a side elevational view of a cam chamber cover to show a surface that opposes to the side wall of the crankcase of FIG. 9.

With reference to FIGS. 10 and 12, a gear chamber cover 138 is preferably affixed to the cam chamber cover 136 to define the gear chamber 126 together with the cam chamber cover 136. A gear unit 140 including gears 142*a*, 142*b*, 142*c* (FIG. 12), 142*d* connects respective ends of the crankshaft 56 and the camshafts 122F, 122R within the gear chamber 126. The crankshaft 56 drives the respective camshafts 122F, 122R through the gear unit 140. Preferably, the crankshaft 56 directly drives the camshaft 122R through the gears 142*a*, 142*b* and the camshaft 122R drives the camshaft 122F through the gears 142*c*, 142*d*.

In the illustrated embodiment, the camshafts 122F, 122R rotate in different directions from each other as shown in FIGS. 8 and 11.

Each camshaft 122F, 122R preferably has cam portions 144*a*, 144*b*. Each cam portion 144*a*, 144*b* has a basic circle surface and a cam surface. The cam surface of the cam portion 144*a* actuates the intake valves 100 of the associated bank 42F, 42R, while the cam surface of the cam portion 144*b* actuates the exhaust valves 114 of the associated bank 42F, 42R, both through another part of the valve drive mechanism 104.

With reference to FIGS. 8, 9, 11, the engine 34 preferably has a lubricating fluid supply conduit 146 to supply lubricating fluid to the cam portions 144*a*, 144*b*. The lubricating fluid preferably is oil. A lubrication system (not shown) can supply a portion of oil in the crankcase 44 to the cam portions 144*a*, 144*b* through the conduit 146. The illustrated conduit 146 extends generally parallel to the camshafts 122F, 122R through an upper portion of the side wall of the crankcase 44 and at least to the cam chamber cover 136. Also, the conduit 146 is located slightly above and between the camshafts 122F, 122R. Because the conduit 146 has a plurality of outlets in the vicinity of the cam portions 144*a*, 144*b*, the lubricating fluid is directed toward the cam portions 144*a*, 144*b*. Additionally, the portion of oil can be further supplied to the gear unit 140 in the gear chamber 126.

With reference to FIGS. 1, 2, 7, 8 and 12, the valve drive mechanism 104 preferably has oil tappets or lifters 150*a*, 150*b* and push rods 152*a*, 152*b*. In the illustrated embodiment, the tappet 150*a* and the push rod 152*a* are associated with the cam portion 144*a*. The tappet 150*b* and the push rod 152*b* are associated with the cam portion 144*b*.

Each oil tappet 150*a*, 150*b* preferably includes a coil spring, a check ball and oil. The tappets 150*a*, 150*b* can inhibit a space from being formed between the valves 100, 114 and the cylinder head body 86 when the valves 100, 114 are placed in the closed position even though the push rods 152*a*, 152*b* expand or shrink in response to the heat of the engine 34. That is, the illustrated tappets 150*a*, 150*b* automatically adjust tappet clearance (i.e., valve clearance).

Each bank 42F, 42R preferably has a tappet holding member 154 that is interposed between the side wall of the crankcase 44 and the cam chamber cover 136. The tappets 150*a*, 150*b* are reciprocally held in the tappet holding member 154. Preferably, the tappets 150*a*, 150*b* incline along the V configuration of the banks 42F, 42R.

In one variation, the tappet holding member 154 can be unitarily formed with the chamber wall 134 of the crankcase 44.

The respective push rods 152*a*, 152*b* extend upward from the associated tappets 150*a*, 150*b* to the cylinder head assemblies 46 along with the V configuration of the banks 42F, 42R. Each bank 42F, 42R also has a push rod cover 156 extending upward from the tappet holding member 154 along the push rods 152*a*, 152*b*. The push rod cover 156 encloses the push rods 152*a*, 152*b*.

When each camshaft 122F, 122R rotates, each cam portion 144*a*, 144*b* pushes the associated tappet 150*a*, 150*b* generally upward at a time when the cam portion 44*a* abuts on the tappet 150*a*, 150*b*. Each push rod 152*a*, 152*b* thus moves also generally upward.

With reference to FIGS. 1, 2, 4, 6 and 7, the valve drive mechanism 104 preferably has an intake rocker arm 160 and an exhaust rocker arm 162 for each cylinder. The foregoing rocker arm mount 88 swingably supports the corresponding set of intake and exhaust rocker arms 160, 162. In the illustrated embodiment, the rocker arm mount 88 has a pair of intake rocker arm supports 164*a* and a pair of exhaust rocker arm supports 164*b* which are unitarily formed on the rocker arm mount 88.

The intake rocker arm 160 preferably comprises an intake rocker arm shaft 166 and two arm portions 168*a*, 168*b*. The intake rocker arm shaft 166 extends generally transversely. The intake rocker arms supports 164*a* journal the intake rocker arm shaft 166. Each arm portion 168*a*, 168*b* extends to a stem head of the respective intake valve 100 from the intake rocker arm shaft 166. Thus, the respective arm portions 168*a*, 168*b* swing to actuate the associated intake valves 100 when the intake rocker arm shaft 166 pivots about its own axis. Each intake valve 100 consequently moves to the fully opened position.

Also, the exhaust rocker arm 162 preferably comprises an exhaust rocker arm shaft 172 and two arm portions 174*a*, 174*b*. The exhaust rocker arm shaft 172 extends generally transversely. The exhaust rocker arms supports 164*b* journal the exhaust rocker arm shaft 172. Each arm portion 174*a*, 174*b* extends to a stem head of the respective exhaust valve 114 from the exhaust rocker arm shaft 172. Thus, the respective arm portions 174*a*, 174*b* swing to actuate the associated exhaust valves 114 when the exhaust rocker arm shaft 172 pivots about its own axis. Each exhaust valve 114 consequently moves to the fully opened position.

In the illustrated embodiment, valve adjusting units 176, 178 are provided between the arm portions 168*b*, 174*b* and the stem heads of the intake and exhaust valves 100, 114, respectively. Each valve adjusting unit 176, 178 includes a screw and a nut. The screw is threaded at a tip portion of the arm portion 168*b*, 174*b* and can abut on the stem head of the associated valve 100, 114. The nut can fix the screw at an adjusted position. A contact state of the arm portion 168*b* with the associated stem head can be equalized with another contact state of the arm portion 168*a* with the associated stem head using the valve adjusting unit 176. Also, a contact state of the arm portion 174*b* with the associated stem head can be equalized with another contact state of the arm portion 174*a* with the associated stem head using the valve adjusting unit 178.

The rocker arm mount 88 preferably has a cylindrical push rod guide 182. The push rod guide 182 preferably interposes the push rod cover 156 together with the tappet holding member 154. The push rod guide 182 extends generally downward. The cylinder head body 86 defines a recessed portion 184 in a space among some cooling fins. As best shown in FIG. 5, the push rod guide 182 preferably fits in the recessed portion 184.

The intake rocker arm 160 preferably has another arm portion 186 extending generally opposite to the arm portions 168*a*, 168*b*. A top end of the push rod 152*a* abuts on a bottom of the another arm portion 186. Thus, the upward movement of the push rod 152*a* pushes the arm portion 186 to rotate the intake rocker arm shaft 166. The arm portions 168*a*, 168*b* consequently actuate the respective intake valves 100.

Also, the exhaust rocker arm 162 preferably has another arm portion 188 extending generally opposite to the arm portions 174*a*, 174*b*. A top end of the push rod 152*b* abuts on a bottom of the another arm portion 188. Thus, the upward movement of the push rod 152*b* pushes the arm portion 188 to rotate the exhaust rocker arm shaft 172. The arm portions 174*a*, 174*b* actuate the respective exhaust valves 114, accordingly.

With reference to FIG. 1, the engine 34 in the illustrated embodiment has a starter motor 192 to start the engine 34. The starter motor 192 preferably is disposed in front of the crankcase 44. Preferably, the starter motor 192 is connected to the crankshaft 56 to drive the crankshaft 56 when the rider of the motorcycle 32 operates the starter motor 192. Once the engine 34 is started, the starter motor 192 is automatically disconnected from the crankshaft 56.

In one variation, a kick starter can replace the starter motor 192. The rider of the motorcycle 32 can manually starts the engine 34 using the kick starter.

The engine also can have other devices, components and members, as is well known in the art. For example, as shown in FIG. 1, an alternator 194 is provided to generate electric power. Further description of the other components of the engine is not believed necessary for an understanding of the present decompression mechanism.

Decompression Mechanism

With reference to FIGS. 12–21, a decompression mechanism 200 configured in accordance with a preferred embodiment of the present invention is described below.

With particular reference to FIGS. 12, 13 and 16–19, each camshaft 122F, 122R preferably has at least one decompression mechanism 200. In some arrangements, however, the engine can include one or more decompression mechanisms 200 on only one of the camshafts. For example, in multiple cylinder engines that have three or more cylinders, one of the decompression mechanisms associated with one of the cylinders is omitted from the design. In the illustrated embodiment, the decompression mechanism 200 of each camshaft 122F, 122R is the same as one another. Thus, the decompression mechanism 200 on the camshaft 122R is exemplary of both of the decompression mechanisms 200 unless otherwise described.

The decompression mechanism 200 preferably comprises a decompression pin 202, a regulating pin or control pin 204, a bias spring 206 and a stopper pin 208. The camshaft 122R (or 122F) has an aperture 210 for the decompression pin 202 and another aperture 212 for the regulating pin 204. Axes of the apertures 210, 212 lie generally normal to each other.

As best shown in FIGS. 14(A)(B) and 15(A)(B), the aperture 210 preferably extends on a center plane of the camshaft 122R that extends generally vertically and intersects with a longitudinal center axis 216 of the camshaft 122R. More specifically, a longitudinal center axis 216 of the aperture 210 extends on and along the center plane, which also includes the center axis 216. The aperture 210 preferably is inclined by an angle θo from a vertical line VL in the center plane such that one end of the aperture 210 is positioned closer to the cam chamber cover 136 than another end of the aperture 210. The former end of the aperture 210 preferably opens at the basic circle surface of the cam portion 144*b*. Also, the former end of the aperture 210 is positioned to oppose to the tappet 150*b* that actuates the exhaust valves 114. The aperture 212 preferably extends perpendicularly to the center plane and interests with the aperture 210. More specifically, a longitudinal center axis 218 of the aperture 212 crosses the longitudinal center axis 216 of the camshaft 122R.

Preferably, the angle θo is larger than 30 degrees and smaller than 50 degrees ($30° < \theta o < 50°$). Because of this angle θo, a weight portion 242 of the regulating pin 204, which will be described below, is prevented from interfering the tappet 150*b*.

The decompression pin 202 is reciprocally disposed within the aperture 210. Generally, the decompression pin 202 is an elongated cylindrical member. Preferably, the decompression pin 202 is circumferentially gradually narrowed in a mid portion thereof to form a circumferential recess or groove 222. In other words, the mid portion is tapered toward a longitudinal center of the member 202. Tapered surfaces are indicated by reference numeral 224 of FIGS. 16–19.

One half portion 228 of the decompression pin 202 is smaller and lighter than another half portion 230 thereof. In the illustrated embodiment, certain part of the half portion 228 is narrowed to reduce weight of this half portion 228. A tip 105 of the half portion 228 can abut on the tappet 150*b* when the tip projects out of the aperture 210. Because the half portion 230 is heavier than the other half portion 228, the decompression pin 202 moves and withdraws the tip of the half portion 228 into the aperture 210 when a certain centrifugal force affects the decompression pin 202 while the camshaft 122R rotates. In this state, the decompression pin 202 is in a non-decompression position or released position. The centrifugal force affected upon the decompression pin 202 is indicated by the arrow Fcd of FIGS. 15(A) and 17. The half portion 228 will be called as "light weight portion" and the other half portion 230 will be called as "heavy weight portion" below.

Figure 16:
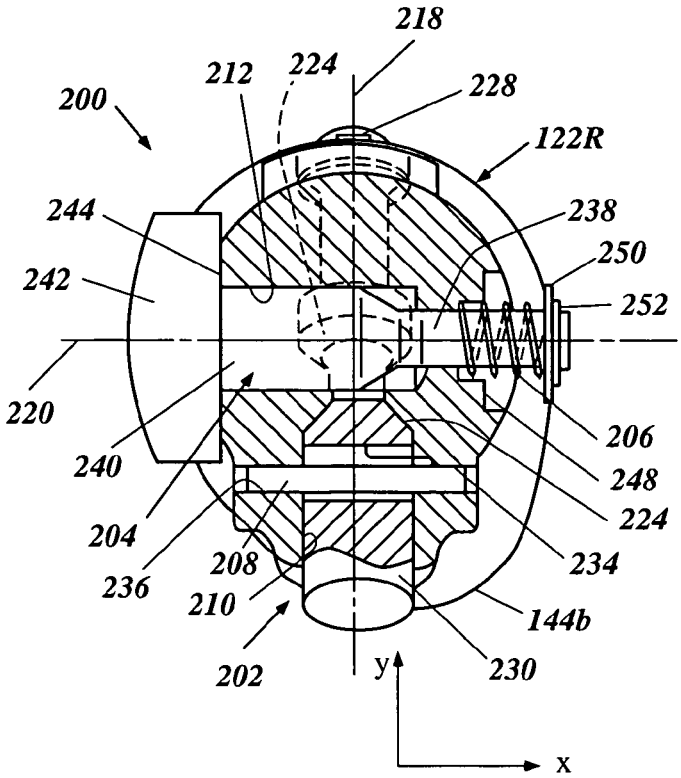
FIG. 16 illustrates an enlarged view corresponding to the view of FIG. 14(B)
Figure 17:
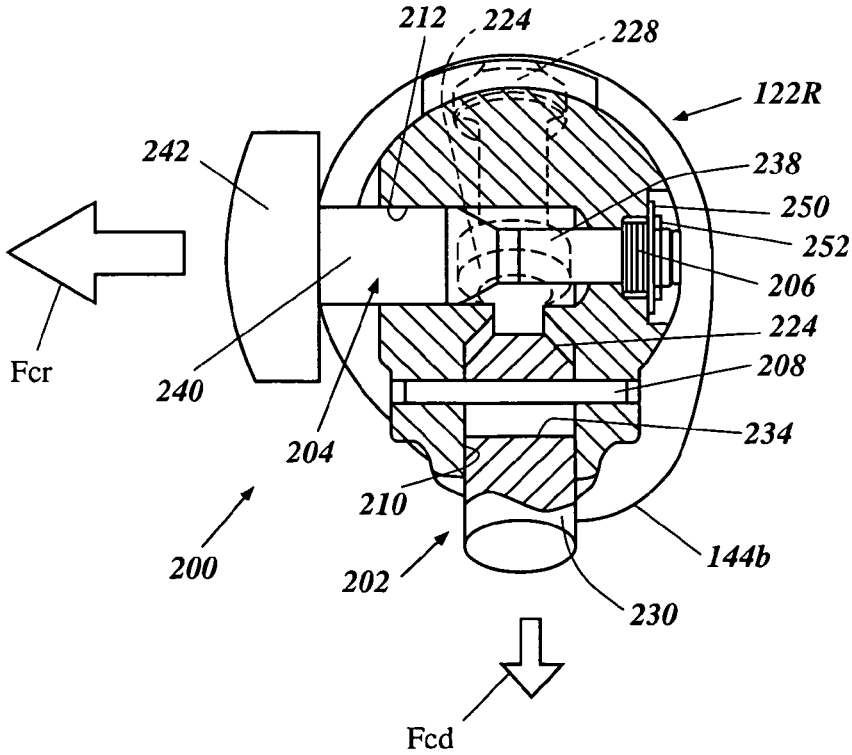
FIG. 17 illustrates an enlarged view corresponding to the view of FIG. 15(B)
Figure 18:
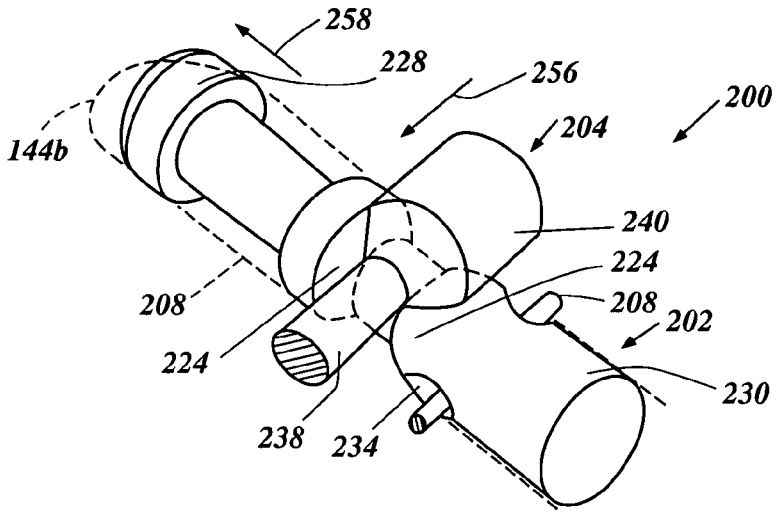
FIG. 18 illustrates a schematic perspective view of the decompression pin and the regulating pin of the decompression mechanism in their respective decompression positions, wherein a weight portion of the regulating pin is omitted.
Figure 19:
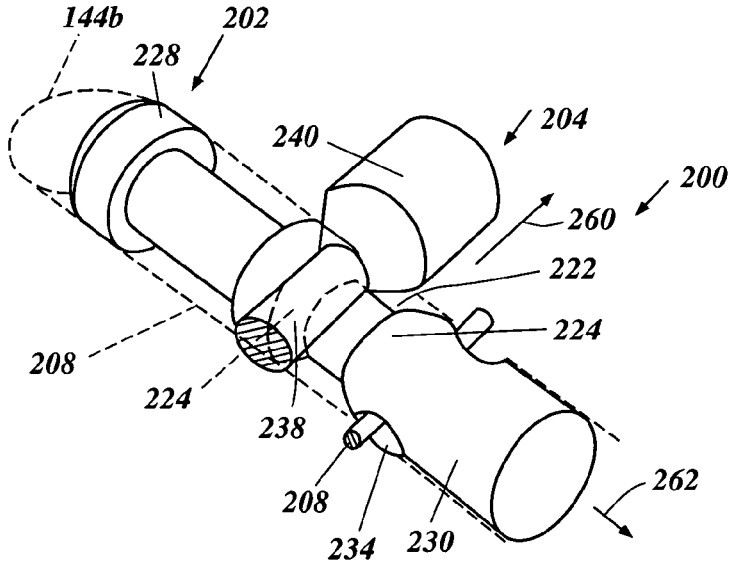
FIG. 19 illustrates a schematic perspective view of the decompression pin and the regulating pin in their respective released positions, wherein the weight portion of the regulating pin also is omitted.

As best seen in FIGS. 16 and 17, the decompression pin 202 preferably has an aperture 234 that extends transversely through the pin 202. The camshaft 122R also has an aperture 236 that extends parallel to the aperture 234. An inner diameter of the aperture 234 preferably is larger than an inner diameter of the aperture 236. The stopper pin 208 extends through the apertures 234, 236. Because the inner diameter of the aperture 234 is larger than the inner diameter of the aperture 236, the decompression pin 202 is movable in a space made by the difference between the inner diameters of the apertures 234, 236. Thus, the tip of the light weight portion 228 can project from the aperture 210 or can withdraw into the aperture 210, as described below.

The regulating pin 204 is reciprocally disposed within the aperture 212. Generally, the regulating pin 204 also is an elongated cylindrical member. Preferably, the decompression pin 202 is circumferentially gradually narrowed generally from a mid portion thereof to one end. In other words, the mid portion is tapered such that an inner diameter of a half portion 238 is smaller than an inner diameter of another half portion 240 thereof. A tapered surface of the regulating pin 204 preferably is consistent with the tapered surface 224 of the decompression pin 202. The half portion 240 itself is heavier than the other half portion 238. In the illustrated embodiment, however, the regulating pin 204 has the weight portion 242 next to the half portion 240 and opposite to the half portion 238. The camshaft 122R preferably has a recess 244 where the weight portion 242 can rest. The regulating pin 204 thus is more sensitive to the centrifugal force than the decompression pin 202. In other words, a centrifugal force indicated by the arrow Fcr of FIGS. 15(B) and 17 is larger than the centrifugal force Fcd created in the same rotational speed of the camshaft 122R.

With reference to FIGS. 16 and 17, the camshaft 122R preferably has another recess 248 on an opposite surface relative to the recess 244. The recess 248 preferably forms a spring retainer. The bias spring 206 preferably is a coil spring and is wound around the narrow half portion 238 of the regulating pin 204. One end of the bias spring 206 is retained by the spring retainer of the recess 248. The narrow half portion 238 preferably has a washer 250 fixed to an end of the narrow half portion 238 by a circlip (or snap ring) 252. Another end of the bias spring 206 is retained by the circlip 252. Thus, the bias spring 206 normally urges the tapered surface of the regulating pin 204 to engage the tapered surface 224 of the decompression pin 202. In this state, illustrated in FIG. 16, the regulating pin 204 is in a regulating position (e.g., an actuating position), and the decompression pin 202 is in a decompression position. On the other hand, when the rotational speed of the camshaft 122R exceeds a preset speed and the centrifugal force Fcr becomes large enough to overcome the urging force of the bias spring 206, as illustrated in FIG. 17, the regulating pin 204 releases the decompression pin 202. In this state, the regulating pin 204 is in a non-regulating position (e.g., in a non-actuating position).

With reference to FIGS. 2, 6, 7, 12, 14(A)(B), 15(A)(B), 16–19, an operation of the decompression mechanism 200 is described below.

When the engine is at rest, (i.e., before the starter motor 192 is operated and the camshafts 122F, 122R are stationary), the decompression mechanisms 200 are in a state shown in FIGS. 14(A)(B), 16 and 18. Each regulating pin 204 is placed in the regulating position because the bias spring 206 forces the regulating pin 204 as indicated by the arrow 256 of FIG. 18. That is, the regulating pin 204 regulates the associated decompression pin 202 to the decompression position in which the tip of the decompression pin 202 projects out of the aperture 210 and abuts on the associated tappet 150*b*. In other words, the tapered surface of the regulating pin 204 pushes the tapered surface 224 of the decompression pin 202 as a wedge. The push rod 152*b* in each bank 42F, 42R thus pushes the arm portion 188 of the exhaust rocker arm 162. The arm portions 174*a*, 174*b* of the exhaust rocker arm 162 actuate the exhaust valves 114 to at least partially open. Thus, at least one of the exhaust valves 114 (even in the compression stroke of the engine 34) stay at least partially as the associated camshaft begins to rotate. Under this condition, the decompression pin 202 receives reaction force from the tappet 150*b*. The reaction force does not affect the regulating pin 204 to return to the non-regulating position.

When the rider operates the starter motor 192, the starter motor 192 rotates the crankshaft 56. The crankshaft 56 then moves the pistons 52 reciprocally within the cylinder bores 50. As noted above, one or more of the exhaust valves 114 are opened in the illustrated embodiment to decompress one or more of the combustion chambers 54. The pistons 52 thus can easily pass the top dead center.

While the rider still operates the starter motor 192, the rotational speed of the camshafts 122F, 122R continues to increase. The centrifugal force Fcr on the regulating pin 204 and the centrifugal force Fcd on the decompression pin 202 gradually become larger. When the rotational speed of the camshafts 122F, 122R exceeds a first predefined speed, the centrifugal force Fcr becomes large enough to overcome the biasing force of the spring 206. The regulating pin 204 thus moves toward the non-regulating position (i.e., non-actuating) as indicated by the arrow 260. Under the condition, the decompression pin 202 is released and is movable within the bore 210.

When the rotational speed of the camshafts 122F, 122R further increase to exceed a second predefined speed, the centrifugal force Fcd becomes large enough to move the decompression pin 202 toward the non-decompression position as indicated by the arrow 262. Thus, the tip of the decompression pin 202 withdraws into the aperture 208. The exhaust valves 114 can return to normal positions, accordingly. In some embodiments, the movement of the decompression pin 202 from the decompression position to the non-decompression position can be aided or entirely effectuated by the reaction force from the tappet 150*b*.

In the stage that the decompression pin 202 moves, the movement of the decompression pin 202 does not affect the regulating pin 204, because the decompression pin 202 has been already released from the regulating pin 204. And at the time that the decompression pin 202 moves to its non-decompression position, the engine 34 has started and operates normally afterwards. The rider (or a control system) then stops operating the starter motor 192.

When desired, the rider may stop the engine operation. As the engine slows and stops, the decompression pin 202 returns to the initial position (i.e., the decompression position) by its own weight and/or by the wedge effect between the tapered surfaces of the decompression pin 202 and the regulating member 204. As such, the decompression pin 202 returns to the initial position when the engine operation is stopped or at a first moment when the starter motor 192 starts driving the crankshaft 56 again. Contribution of the wedge effect to this action depends on a size of the bias spring 206. If the urging force of the spring is large, the wedge effect contributes largely. If, on the other hand, the urging force of the spring is small, the wedge effect is not so large. In the latter situation, the tapered surfaces can be relatively rough without finishing processes.

In one variation, the decompression pin 202 can be moved to the non-decompression position not by the centrifugal force Fcd but by the reaction force of the tappet 150*b*, as noted above. In this variation, the center of gravity of the decompression pin 202 does not need to be positioned closer to the half portion 230 than the other half portion 228.

In the above description, the weight of the regulating pin 204 is omitted for a simple explanation of the operation. Actually, however, the weight of the regulating pin 204 affects the stability of the regulating pin 204 at relatively low rotational speeds of the camshaft 122F, 122R.

The weight of the regulating pin 204 can be larger than the urging force of the bias spring 206. That is, if the weight of the regulating pin 204 is W and the urging force of the bias spring 206 is Fs, the bias spring 206 preferably is smaller than the weight of the regulating pin 204 (i.e., W<Fs). This is preferred to keep the regulating pin 204 from fluctuate within the aperture 212. However, the foregoing setting can give the decompression mechanism 200 a relatively large size. If a compact size mechanism is needed, the weight W of the regulating pin 204 preferably is smaller than the urging force of the bias spring 206 (Fs<W). Even under the condition Fs<W, the regulating pin 204 will stop fluctuating when the centrifugal force Fcr becomes larger than the sum of the urging force Fs and the absolute value of the weight W (i.e., Fcr>Fs+|W|).

Figure 20:
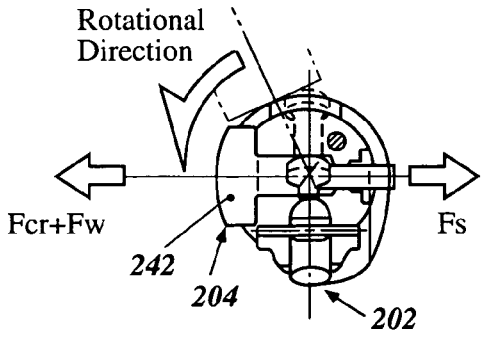
FIG. 20 illustrates a schematic cross-sectional view of the camshaft under a condition that the regulating pin extends normal to the perpendicular plane.
Figure 21:
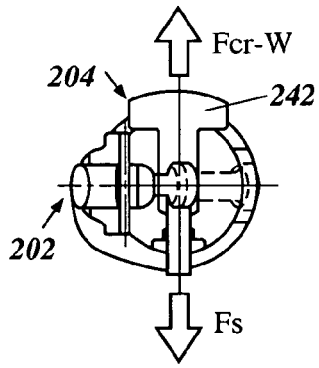
FIG. 21 illustrates a schematic cross-sectional view of the camshaft under another condition that the regulating pin extends along the perpendicular plane and a weight portion of the regulating pin is positioned atop.

With reference to FIGS. 20 and 21, the relationships between the urging force Fs, the weight W of the regulating pin 204 and the centrifugal force Fcr is described below.

The weight W can change between the maximum +W and the minimum −W when the camshaft 122F, 122R rotates. In general, as shown in FIG. 20, if a component of the weight W is Fw at a certain angle of the camshaft 122F, 122R, the regulating pin 204 is positioned at the regulating position when the urging force Fs is larger than the resultant force of the centrifugal force Fcr and the component of the weight Fw (i.e., Fcr+Fw<Fs). On the other hand, the regulating pin 204 is positioned at the non-regulating position when the urging force Fs is smaller than the resultant force of the component of the centrifugal force Fcr and the weight Fw (i.e., Fs<Fcr+Fw).

When the weight portion 242 is located at the top of the regulating pin 204, the resultant force Fcr+Fw can be the minimum (=Fcr−W) as shown in FIG. 21 because the weight W is reversed. Thus, if the centrifugal force Fcr is less than the resultant force of the urging force Fs and the absolute value of the weight W (i.e., Fcr<Fs+|W|), the regulating pin 204 repeats the reciprocal movement within the aperture 212 under the condition that the urging force Fs is less than the weight W (i.e., Fs<W). On the other hand, if the centrifugal force Fcr is greater than the resultant force of the urging force Fs and the absolute value of the weight W (i.e., Fs+|W|<Fcr), the regulating pin 204 does not repeat the reciprocal movement within the aperture 212 and can be stable also under the condition that the urging force Fs is less than the weight W (i.e., Fs<W). However, if the urging force Fs is greater than the weight W (i.e., W<Fs), the regulating pin 204 can generally be always stable.

Figure 22:
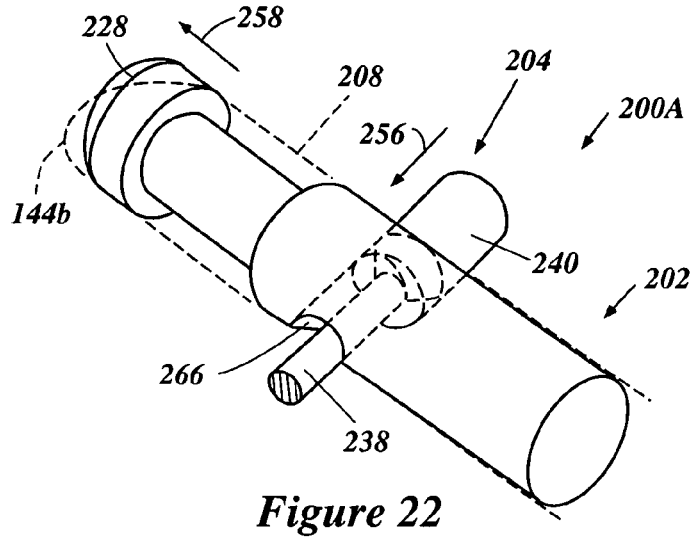
FIG. 22 illustrates a schematic view of an another decompression mechanism placed in the decompression position.
Figure 23:
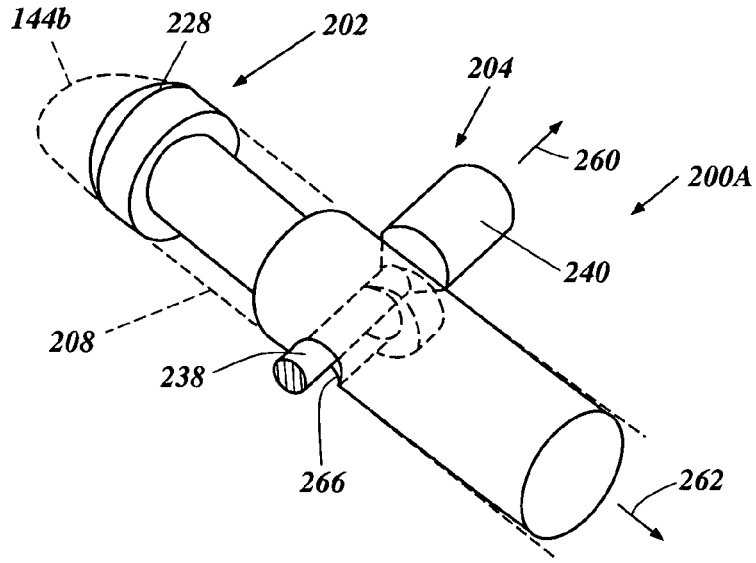
FIG. 23 illustrates a schematic view of the decompression mechanism of FIG. 22 placed in the released position.

The components of the decompression mechanism 200 can have various configurations and arrangements. For example, the circumferential recess 222 is not necessarily formed circumferentially. Also, with reference to FIGS. 22 and 23, a relatively large aperture 266 can replace the circumferential recess 222 in another decompression mechanism 200A. The illustrated aperture 266 extends transversely and normal to a longitudinal axis of the decompression pin 202. Preferably, an axis of the aperture 266 intersects the longitudinal axis. An inner diameter of the aperture 266 preferably is larger than an outer diameter of the narrow half portion 238 such that the decompression pin 202 is movable along its longitudinal axis. In this variation and even in the foregoing embodiment, the stopper pin 208 and the apertures 234, 236 can be omitted because the regulating pin 204 can act as the stopper pin 208. In another variation, a recess defined in the camshaft 122R and a projection extending to the recess from the decompression pin 202 can replace the stopper pin 208.

Figure 24:
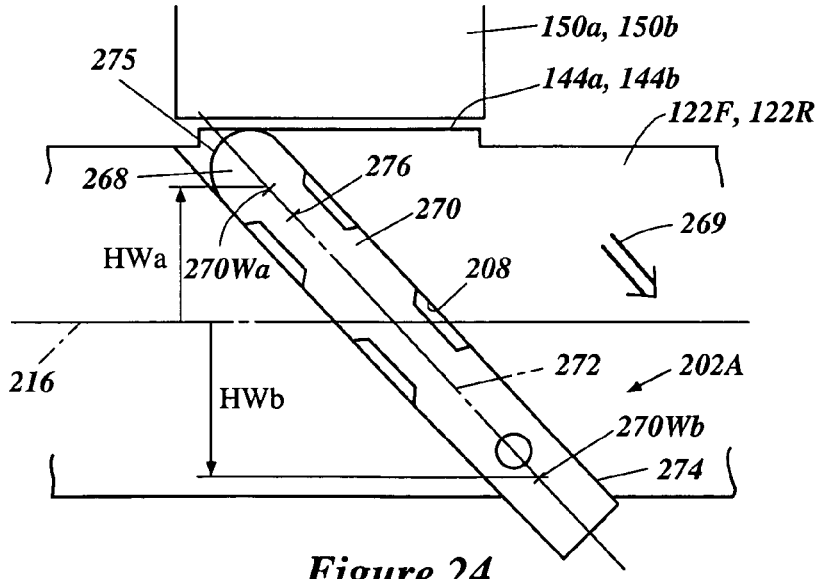
FIG. 24 illustrates a schematic view of an additional decompression pin.

With reference to FIG. 24, a modified decompression pin 202A can replace the foregoing decompression pin 202. A configuration and a weight of the decompression pin 202A are determined as such the following expression is obtained:

$$Wa*HWa<Wb*HWb$$

where Wa indicates a weight of an upper portion 270 of the decompression pin 202A that exists above the longitudinal axis 216 of the camshaft 122F, 122R under a condition that a tip 268 of the decompression pin 202A completely withdraws into the aperture 208 as indicated by the arrow 269; HWa indicates a distance between the longitudinal axis 216 and a center of gravity 270Wa of the upper portion 270; Wb indicates a weight of a lower portion 274 of the decompression pin 202A that exits below the longitudinal axis 216 of the camshaft 122F, 122R under the same condition; and HWb indicates a distance between the longitudinal axis 216 and a center of gravity 270Wb of the lower portion 274. In order to make the expression effective, for example, the lower portion 274 can have a greater weight or have greater mass than the upper portion 270. Because of the configuration and the weight arrangement, the decompression pin 202A can easily withdraw into the aperture 208 when the sufficient centrifugal force affects the weight end of decompression pin 202A.

Additionally, the illustrated tip 268 of the decompression pin 202A has a spherical surface 275. The center of curvature of the spherical surface is positioned at a point 276 on the longitudinal axis 272.

Figure 25:
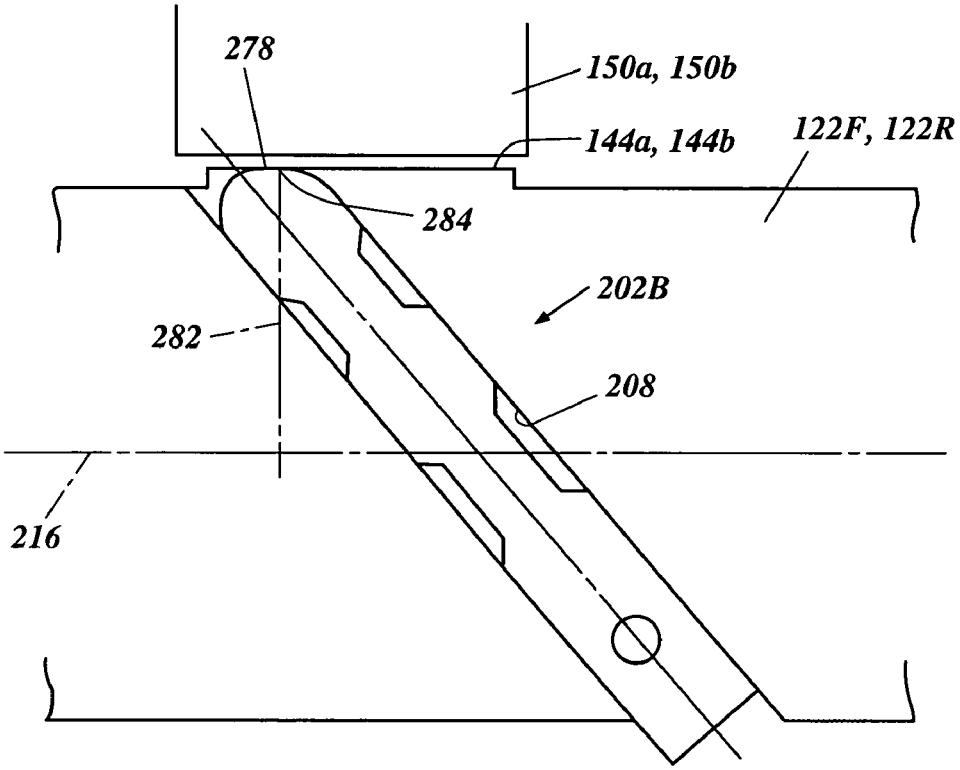
FIG. 25 illustrates a schematic view of another variation of the decompression pin.

With reference to FIG. 25, another modified decompression pin 202B can replace the foregoing decompression pin 202. The decompression pin 202B also has a semi-spherical surface 278. In this variation, however, the center of curvature of the spherical surface is positioned at a different point 280. The point 280 is located on a normal line 282 that extends from a contact point 284 at which the decompression pin 202B contacts the bottom of the tappet 150*a*, 150*b*.

Because of this arrangement, the pushing force by the decompression pin 202B can be effectively transmitted to the tappet 150*a*, 150*b* while the pin 202B abuts on the tappet 150*a*, 150*b*. Thus, the tappet 150*a*, 150*b* can be surely kept in the decompression position.

As thus described above, the decompression mechanism 200 in the illustrated embodiment only needs the decompression pin 202, the regulating pin 204 and the bias spring 206. The construction of the decompression mechanism 200 thus is quite simple and compact. In addition, almost the entire part of the decompression mechanism 200 is formed within the camshaft 122F, 122R. The construction of the decompression mechanism 200 is useful particularly for an engine in which only a small space is available for the decompression mechanism 200. However, it should be noted that the decompression mechanism 200 is also advantageous for other types of engines.

The decompression pin 202 and the regulating pin 204 are not necessarily disposed normal to each other. Those pins 202, 204, however, need to extend in a non-parallel relationship with each other.

With reference to FIGS. 26–30, another decompression mechanism 200A modified in accordance with another embodiment of the present invention is described. The same or similar components or members as those described above are assigned the same reference numerals as given above and the above description of such components and members should be understood to apply equally to the same or similar components of the embodiment illustrated in FIGS. 26–30. Although both of the camshafts 122F, 122R can have a decompression mechanism 200A, only the decompression mechanism 200A disposed on the camshaft 122R is described below with it being understood that, unless noted otherwise, the same description applied to the decompression mechanism 200A on the other camshaft (if one is used).

Figure 26:
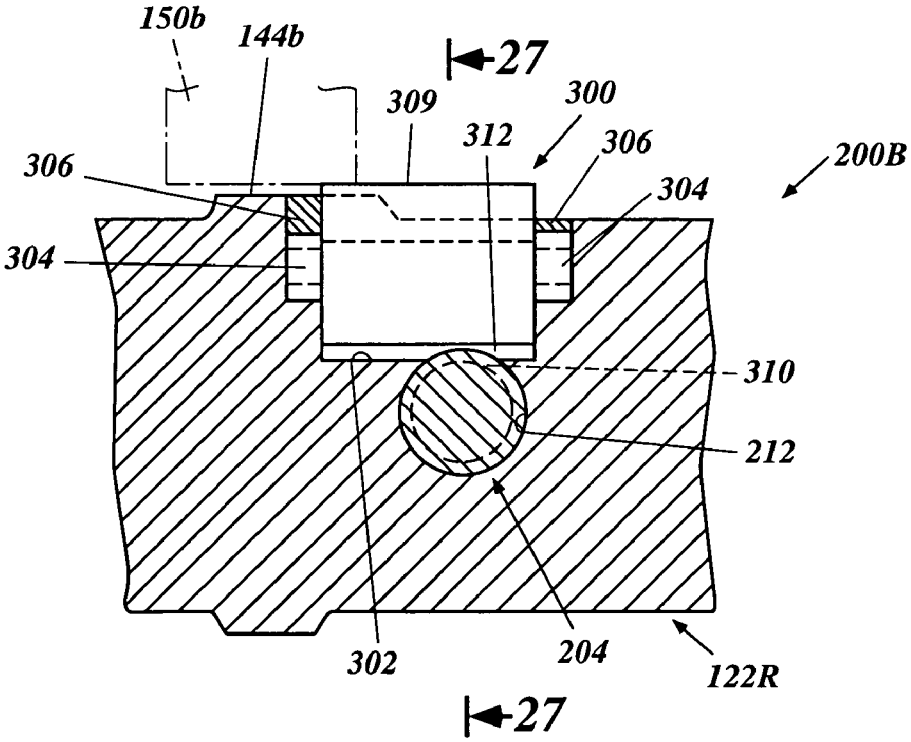
FIG. 26 illustrates a cross-sectional view of a camshaft taken along a center axis of the camshaft, the camshaft incorporates another decompression mechanism modified in accordance with another embodiment of the present invention.
Figure 27:
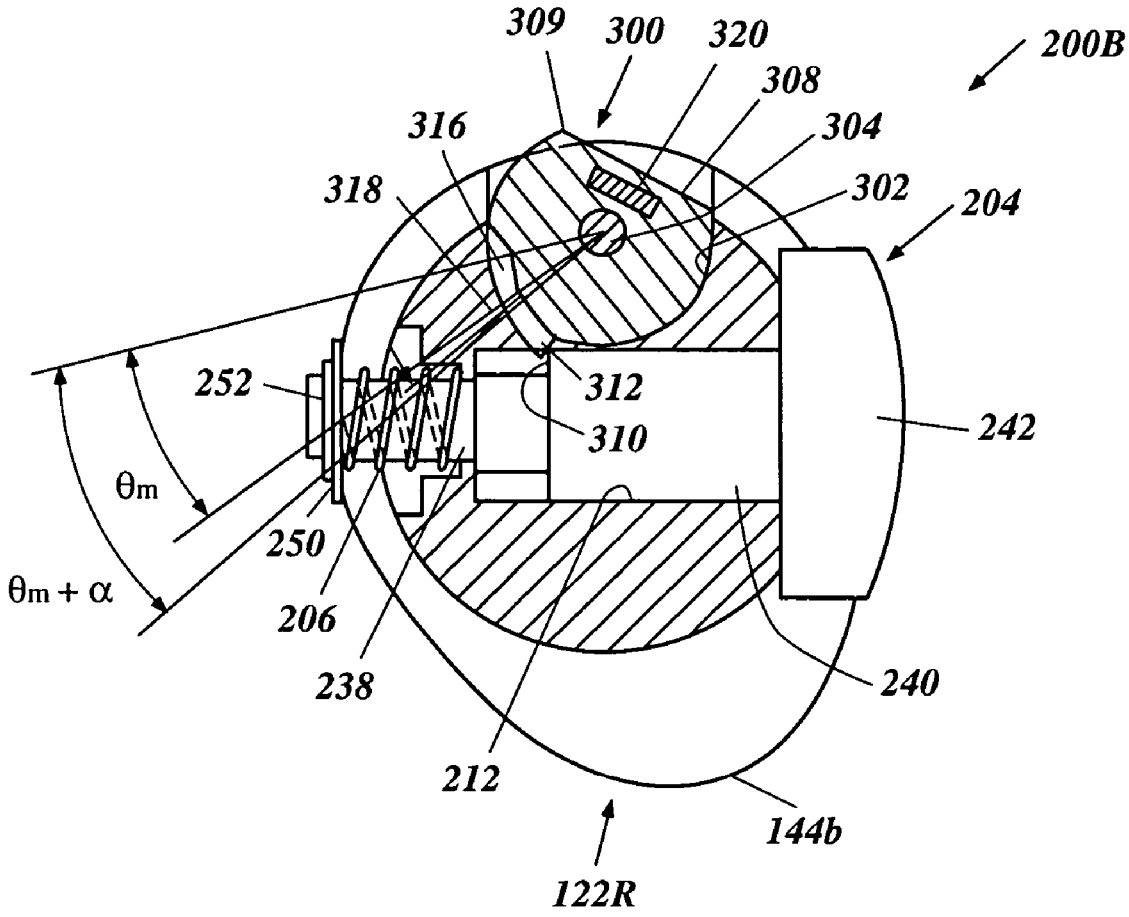
FIG. 27 illustrates a cross-sectional view of the camshaft taken along the line 27—27 of FIG. 26.

With reference to FIGS. 26 and 27, generally, the decompression mechanism 200A has the same or similar regulating pin 204 and the bias member 206. The regulating pin 204 extends through the aperture 212. In the decompression mechanism 200A, a decompression cam 300 replaces the foregoing decompression pin 202.

As best shown in FIG. 26, the camshaft 122R preferably has a recessed portion 302 that accommodates the decompression cam 300 therein. The recessed portion 302 preferably communicates with the aperture 212. The decompression cam 300 preferably has a shaft 304 affixed to the camshaft 122R. The shaft 304 pivotally supports the decompression cam 300. Thus, the decompression cam 300 can pivot about an axis of the shaft 304. Preferably, the axis of the shaft 304 extends generally normal to the longitudinal axis of the regulating pin 204. A closure member 306 preferably closes the recessed portion 302 and keeps the shaft 304 in a fixed position.

As best shown in FIG. 27, preferably, the decompression cam 300 is generally cylindrically shaped. An outer diameter of the decompression cam 300 preferably is configured such that a peripheral portion of the cam 300 can be exposed from the recessed portion 302. One portion of the cylindrical shape preferably is cut away to create a flat surface 308. A cam projection 309 thus is formed at a corner of the flat surface 308.

The regulating member 204 in this embodiment has a step 310 instead of the tapered surface. The decompression cam 300 has a step 312 that can engage the step 310 of the regulating pin 204. The step 310 of the regulating pin 204 regulates an angular position of the decompression cam 300. That is, in FIG. 27, the step 310 stops an anti-clockwise rotation of the decompression cam 300. When the regulating pin 204 is placed in the regulating position as shown in FIG. 27, the cam projection 309 projects out of the basic circle surface of the cam portion 144*b* of the camshaft 122R.

The decompression cam 300 preferably has a recess 316 on a peripheral surface generally opposite to the flat surface 308. An engage member 318 preferably extends toward the recess 316 from the camshaft 122R in the recessed portion 302. The engage member 318 can engage one of circumferential ends of the recess 316 when the decompression cam 300 rotates. That is, the recess 316 and the engage member 318 regulate a range $\theta m$ of the rotation of the decompression cam 300. Preferably, the recess 316 has an angular range $\theta m+\alpha$ because the engage member 318 has a thickness of the angle $\alpha$. The decompression cam 300 thus cannot rotate beyond the range $\theta m$.

The decompression cam 300 preferably has a weight member 320. The illustrated weight member 320 is embedded in the decompression cam 300 between the shaft 304 and the flat surface 308. The decompression cam 300 thus can pivot within the range $\theta m$ when a centrifugal force affects the decompression cam 300 while the camshaft 122R rotates.

Figure 28:
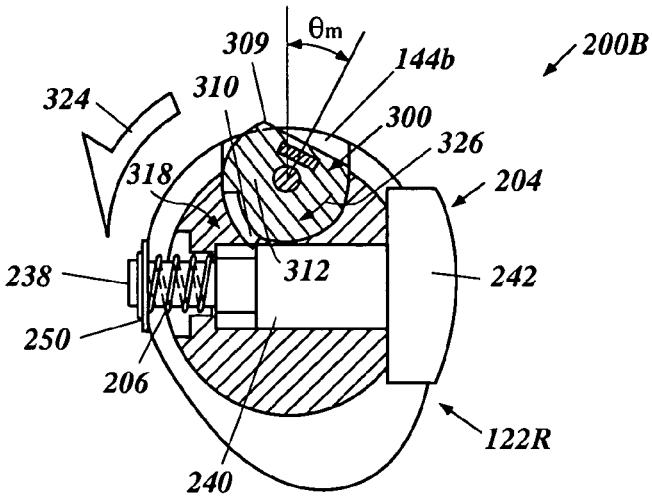
FIG. 28 illustrates a cross-sectional view similar to the view of FIG. 27 to show the decompression mechanism of FIG. 26 placed in a decompression position.
Figure 29:
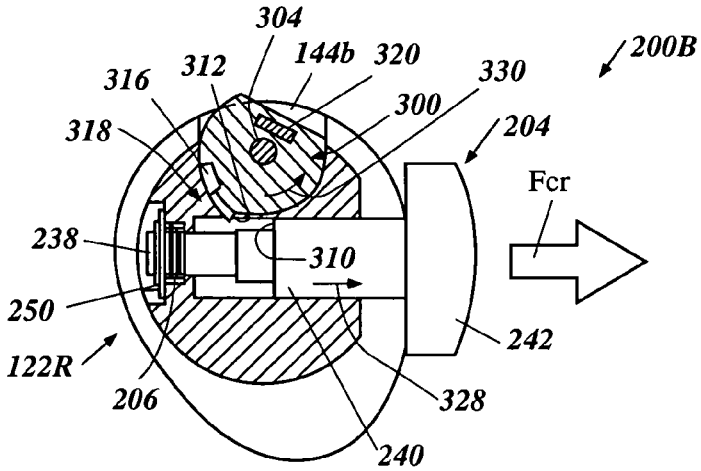
FIG. 29 illustrates a cross-sectional view similar to the view of FIG. 27 to show the decompression mechanism of FIG. 26 changing to a released position from the decompression position.
Figure 30:
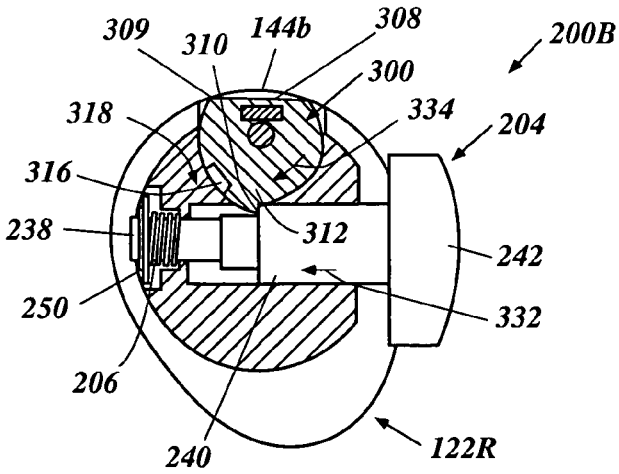
FIG. 30 illustrates a cross-sectional view similar to the view of FIG. 27 to show the decompression mechanism of FIG. 26 changing to the released position to the decompression position.

With reference to FIGS. 28–30, an operation of the modified decompression mechanism 200A is described below.

With reference to FIG. 28, when the camshaft 122R stands still or rotates with a rotational speed less than a predetermined speed in a direction indicated by the arrow 324, the regulating pin 204 is placed in the regulating position by the urging force of the bias spring 206. This is because the centrifugal force affecting the regulating pin 204 is smaller than the urging force of the bias spring 206. The step 310 of the regulating pin 204 pushes the step 312 of the decompression cam 300 in a direction indicated by the arrow 326. The cam projection 309 of the decompression cam 300 thus projects out of the basic circular surface of the camshaft 122R and urges the tappet 150*b* to open the exhaust valve(s) 114. This is the decompression position of the decompression cam 300.

More in detail, in a first moment that the decompression cam 300 starts abutting on the tappet 150*b*, friction force generated by the tappet 150*b* is apt to move the decompression cam 300 in the direction 326 (clockwise). However, the decompression cam 300 does not move because the engage member 318 prevents the decompression cam 300 from moving in the direction 326. Next, when the decompression cam 300 further rotates, the decompression cam 300 receives the reaction force from the tappet 150*b* in a reverse direction (anti-clockwise). If the reaction force is greater than the urging force of the bias spring 206, the decompression cam 300 can rotate in the reverse direction and the decompression cam 300 can change to the non-compression position. In order to prevent this earlier change, the urging force of the bias spring 206 preferably is greater than the reaction force. However, because the decompression cam 300 can stay in the decompression position at least in the initial stage, the decompression mechanism 200A can achieve a certain extent of the objective even if the urging force of the bias spring 206 is less than the reaction force.

With reference to FIG. 29, when the rotational speed of the camshaft 122R increases and exceeds the predefined speed, the centrifugal force on the regulating member 204 becomes large enough to overcome the urging force of the bias spring 206. The regulating pin 204 thus moves toward the non-regulating position in a direction indicated by the arrow 328. The decompression cam 300 is released and can pivot in a direction indicated by the arrow 330. Under the condition, the decompression cam 300 pivots in the direction indicated by the arrow 330 within the range $\theta m$ limited by the recess 316 and the engage member 318 because of the centrifugal force affecting the weight member 320. Thus, the decompression cam 300 can be placed in the released or non-decompression position and can stay in this position.

With reference to FIG. 30, when the rotational speed of the camshaft 122R decreases toward zero, the centrifugal force exerted upon the regulating pin 204 becomes smaller than the urging force of the bias spring 206. The regulating pin 204 moves back to its initial position in a direction indicated by the arrow 332 because the bias spring 206 urges. The step 310 of the regulating pin 204 thus engages the step of the decompression cam 300 and pushes the decompression cam 300 in a direction 334. The decompression cam 300 returns to the initial position (i.e., the decompression position), accordingly. Preferably, the centrifugal force generated in a rotational speed of the camshaft 122R corresponding to an idle engine speed still overcome the urging force of the bias spring 206.

Although this invention has been disclosed in the context of certain preferred embodiments, it will be understood by those skilled in the art that the present invention extends beyond the specifically disclosed embodiments to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A four stroke engine comprising an engine body defining a cylinder bore, a piston reciprocally disposed within the cylinder bore and defining a combustion chamber with the engine body and the cylinder bore, a crankshaft coupled to the piston so as to rotate with a movement of the piston, at least one valve movable between a closed position and at least a first open position, the combustion chamber being open when the valve is moved to the first open position, a camshaft driven by the crankshaft, the camshaft having a cam portion to move the valve, a decompression member disposed on the camshaft, the decompression member being movable between a first position and a second position, a portion of the decompression member being configured to place the valve generally at the first open position when the decompression member moves to the first position and releasing the valve from the first open position when the decompression member moves to the second position from the first position, a regulating member carried by the camshaft, the regulating member movable between a regulating position and a non-regulating position where the regulating member regulates movement of the decompression member when the regulating member is at its regulating position, the regulating member releasing the decompression member from the first position when the regulating member is at its non-regulating position, and a bias member arranged to urge the regulating member toward its regulating position, the regulating member being configured so as to move toward the non-regulating position against the urging force of the bias member when a rotational speed of the camshaft exceeds a predefined speed; wherein the camshaft defines a first aperture and a second aperture, the first and second apertures at least partially intersect with each other, and the decompression member extends through a first aperture and the regulating member extends through the second aperture to cross the decompression member and wherein the first aperture and the second aperture cross generally normal to each other.

2. The engine as set forth in claim 1, wherein the regulating member has a first end portion and a second end portion, the bias member is disposed closer to the first end portion than the second end portion, and a center of gravity of the regulating member is positioned closer to the second end portion than the first end portion.

3. The engine as set forth in claim 2, wherein the portion of the decompression member is a first end portion and the decompression member has a second end portion, and a center of gravity of the decompression member is positioned closer to the second end portion than the first end portion.

4. The engine as set forth in claim 3, wherein a weight of the second end portion of the regulating member is larger than a weight of the second end portion of the decompression member.

5. The engine as set forth in claim 1, wherein the portion of the decompression member is a first end portion and the decompression member has a second end portion, and a center of gravity of the decompression member is positioned closer to the second end portion than the first end portion.

6. The engine as set forth in claim 1, wherein the decompression member has a first engage portion, the regulating member has a second engage portion that engages the first engage portion of the decompression member to actuate the decompression member to the first position when the regulating member is placed at the regulating position.

7. The engine as set forth in claim 1, wherein a space is created between the decompression member and the regulating member when the regulating member is placed at the non-regulating position.

8. The engine as set forth in claim 1, wherein the camshaft defines an aperture and a recess that communicates with the aperture, the regulating member extends through the aperture, and the decompression member is pivotally disposed in the recess to selectively engage the regulating member.

9. The engine as set forth in claim 1, wherein the engine body comprises a pair of banks and a crankcase, each bank defines the cylinder bore in which the piston is reciprocally disposed, the banks extend from the crankcase in a V configuration, and the crankcase has a pair of the camshafts for the respective banks.

10. The engine as set forth in claim 1, wherein the urging force of the bias member is less than a weight of the regulating member.

11. The engine as set forth in claim 1 additionally comprising an intermediate device arranged to transmit movement of the cam portion to the valve, and wherein the portion of the decompression member projects to contact the intermediate member when the decompression member is placed at the first position.

12. A four stroke engine comprising an engine body defining a cylinder bore, a piston reciprocally disposed within the cylinder bore and defining a combustion chamber with the engine body and the cylinder bore, a crankshaft rotatable with movement of the piston, at least one valve movable between at least a first open position and a closed position, the combustion chamber being open when the valve is placed at the first open position, a camshaft driven by the crankshaft, the camshaft having a cam portion to actuate the valve, a first member movable within a first guide aperture of the camshaft, the first member having a first end and a second end, a second member movable within a second guide aperture, and a bias member disposed at one end of the second member to urge the second member to engage the first member, the second member being arranged to keep the first member in a decompression position where the first end of the first member projects out of the camshaft to move the valve to the first open position when a centrifugal force affecting the second member does not overcome an urging force of the bias member, the second member being further arranged to release the first member from the decompression position when the centrifugal force overcomes the urging force of the bias member, a center of gravity of the first member being positioned closer to the second end than the first end such that the first member withdraws into the first guide aperture when the centrifugal force affects the first member; wherein the first guide aperture and the second guide aperture cross generally normal to each other.

13. The engine as set forth in claim 12, wherein the second member has a first end and a second end, the bias member is disposed closer to the first end than the second end, and a center of gravity of the second member is positioned closer to the second end than the first end.

14. The engine as set forth in claim 1, wherein the decompression member and the regulating member have longitudinal axes that extend generally perpendicular to the longitudinal axis of the camshaft.

15. The engine as set forth in claim 12, wherein the first member and the second member are disposed generally normal to a longitudinal axis of the camshaft.

16. A four stroke engine comprising an engine body defining a cylinder bore, a piston reciprocally disposed within the cylinder bore and defining a combustion chamber with the engine body and the cylinder bore, a crankshaft coupled to the piston so as to rotate with a movement of the piston, at least one valve movable between a closed position and at least a first open position, the combustion chamber being open when the valve is moved to the first open position, a camshaft driven by the crankshaft, the camshaft having a cam portion to move the valve, a decompression member disposed on the camshaft, the decompression member being movable between a first position and a second position, a portion of the decompression member being configured to place the valve generally at the first open position when the decompression member moves to the first position and releasing the valve from the first open position when the decompression member moves to the second position from the first position, a regulating member carried by the camshaft, the regulating member movable between a regulating position and a non-regulating position where the regulating member regulates movement of the decompression member when the regulating member is at its regulating position, the regulating member releasing the decompression member from the first position when the regulating member is at its non-regulating position, and a bias member arranged to urge the regulating member toward its regulating position, the regulating member being configured so as to move toward the non-regulating position against the urging force of the bias member when a rotational speed of the camshaft exceeds a predefined speed; wherein the camshaft defines a first aperture and a second aperture, the first and second apertures at least partially intersect with each other, and the decompression member extends through a first aperture and the regulating member extends through the second aperture to cross the decompression member and wherein the decompression member and the regulating member are disposed generally normal to a longitudinal axis of the camshaft.

17. The engine as set forth in claim 16, wherein the regulating member has a first end portion and a second end portion, the bias member is disposed closer to the first end portion than the second end portion, and a center of gravity of the regulating member is positioned closer to the second end portion than the first end portion.

18. The engine as set forth in claim 17, wherein the portion of the decompression member is a first end portion and the decompression member has a second end portion, and a center of gravity of the decompression member is positioned closer to the second end portion than the first end portion.

19. The engine as set forth in claim 18, wherein a weight of the second end portion of the regulating member is larger than a weight of the second end portion of the decompression member.

20. A four stroke engine comprising an engine body defining a cylinder bore, a piston reciprocally disposed within the cylinder bore and defining a combustion chamber with the engine body and the cylinder bore, a crankshaft rotatable with movement of the piston, at least one valve movable between at least a first open position and a closed position, the combustion chamber being open when the valve is placed at the first open position, a camshaft driven by the crankshaft, the camshaft having a cam portion to actuate the valve, a first member movable within a first guide aperture of the camshaft, the first member having a first end and a second end, a second member movable within a second guide aperture, and a bias member disposed at one end of the second member to urge the second member to engage the first member, the second member being arranged to keep the first member in a decompression position where the first end of the first member projects out of the camshaft to move the valve to the first open position when a centrifugal force affecting the second member does not overcome an urging force of the bias member, the second member being further arranged to release the first member from the decompression position when the centrifugal force overcomes the urging force of the bias member, a center of gravity of the first member being positioned closer to the second end than the first end such that the first member withdraws into the first guide aperture when the centrifugal force affects the first member, wherein the first member and the second member have longitudinal axes that extend generally perpendicular to the longitudinal axis of the camshaft.

21. The engine as set forth in claim 20, wherein the second member has a first end and a second end, the bias member is disposed closer to the first end than the second end, and a center of gravity of the second member is positioned closer to the second end than the first end.

* * * * *